US009032855B1

(12) United States Patent
Foren et al.

(10) Patent No.: US 9,032,855 B1
(45) Date of Patent: May 19, 2015

(54) AMMUNITION ARTICLES AND METHODS FOR MAKING THE SAME

(71) Applicant: Carolina PCA, LLC, Cary, NC (US)

(72) Inventors: Wayne S. Foren, Cary, NC (US); Joshua Kratky, Chapel Hill, NC (US); Gary Smith, Youngsville, NC (US); David Jackson, Zebulon, NC (US); Norton Gallego, Raleigh, NC (US)

(73) Assignee: Carolina PCA, LLC, Cary, NC (US)

( * ) Notice: Subject to any disclaimer, the term of this patent is extended or adjusted under 35 U.S.C. 154(b) by 0 days.

(21) Appl. No.: 13/794,766

(22) Filed: Mar. 11, 2013

Related U.S. Application Data

(60) Provisional application No. 61/609,237, filed on Mar. 9, 2012.

(51) Int. Cl.

| | |
|---|---|
| ***F42B 33/00*** | (2006.01) |
| ***B21D 51/54*** | (2006.01) |
| ***B21K 21/06*** | (2006.01) |
| ***F42B 33/02*** | (2006.01) |
| ***F42B 33/04*** | (2006.01) |

(52) U.S. Cl.
CPC ..... *F42B 33/00* (2013.01); *F42B 33/0207* (2013.01); *F42B 33/04* (2013.01)

(58) Field of Classification Search
USPC ..... 102/466, 467, 516, 517; 86/19.5, 51, 55
See application file for complete search history.

(56) References Cited

U.S. PATENT DOCUMENTS

| | | | | |
|---|---|---|---|---|
| 3,694,529 | A * | 9/1972 | Josephsen et al. | 264/48 |
| 3,911,074 | A * | 10/1975 | Kessler | 264/318 |
| 4,157,684 | A | 6/1979 | Clausser | |
| 4,508,036 | A * | 4/1985 | Jensen et al. | 102/444 |
| 4,546,704 | A * | 10/1985 | Ballreich et al. | 102/444 |
| 4,809,612 | A * | 3/1989 | Ballreich et al. | 102/466 |
| 4,958,567 | A | 9/1990 | Olson et al. | |
| 5,176,839 | A * | 1/1993 | Kim | 249/78 |
| 5,259,288 | A | 11/1993 | Vatsvog | |
| 5,770,815 | A | 6/1998 | Watson et al. | |
| 5,822,904 | A | 10/1998 | Beal et al. | |
| 6,283,035 | B1 | 9/2001 | Olson et al. | |
| 6,752,084 | B1 | 6/2004 | Husseini et al. | |
| 6,845,716 | B2 | 1/2005 | Husseini et al. | |
| 7,059,234 | B2 | 6/2006 | Husseini | |
| 7,441,504 | B2 | 10/2008 | Husseini et al. | |
| 7,610,858 | B2 | 11/2009 | Chung | |
| 8,240,252 | B2 | 8/2012 | Maljkovic et al. | |
| 8,443,730 | B2 * | 5/2013 | Padgett | 102/466 |

(Continued)

OTHER PUBLICATIONS

Crane Using Lightweight .50 Cal Ammo, Sep. 13, 2011, http://kitup.military.com/2011/09/crane-using-lightweight-50-cal-ammo.html, last accessed Apr. 2, 2013.

*Primary Examiner* — Jonathan C Weber
(74) *Attorney, Agent, or Firm* — NKK Patent Law, PLLC

(57) ABSTRACT

A method of making an ammunition article and associated ammunition article is provided. The ammunition article is interchangeable with standard ammunition articles and to operate in standard chambers of standard weapons systems and of the type having a casing including a sidewall that defines a casing volume within. The method includes determining a desired propellant charge volume for a given ammunition article, determining a thickness of the casing sidewall such that the casing volume substantially corresponds to the desired propellant charge volume, and forming the casing having the determined thickness.

19 Claims, 32 Drawing Sheets

(56) References Cited

U.S. PATENT DOCUMENTS

| | | | | |
|---|---|---|---|---|
| 8,561,543 | B2 * | 10/2013 | Burrow | 102/467 |
| 2001/0013299 | A1 * | 8/2001 | Husseini et al. | 102/466 |
| 2003/0131751 | A1 | 7/2003 | Mackerell | |
| 2005/0081704 | A1 * | 4/2005 | Husseini | 86/55 |
| 2005/0188883 | A1 * | 9/2005 | Husseini et al. | 102/466 |
| 2005/0257711 | A1 * | 11/2005 | Husseini et al. | 102/466 |
| 2005/0257712 | A1 * | 11/2005 | Husseini et al. | 102/466 |
| 2006/0011087 | A1 * | 1/2006 | Husseini et al. | 102/466 |
| 2007/0044644 | A1 * | 3/2007 | Husseini | 86/19.5 |
| 2009/0044717 | A1 * | 2/2009 | Husseini et al. | 102/466 |
| 2012/0111219 | A1 * | 5/2012 | Burrow | 102/467 |
| 2012/0180687 | A1 * | 7/2012 | Padgett et al. | 102/466 |
| 2012/0180688 | A1 * | 7/2012 | Padgett | 102/466 |
| 2014/0060372 | A1 * | 3/2014 | Padgett | 102/466 |
| 2014/0060373 | A1 | 3/2014 | Maljkovic et al. | |

* cited by examiner

2010

610

710

1210

2010

2010

2410

2410

2710

AMMUNITION ARTICLES AND METHODS FOR MAKING THE SAME

CROSS-REFERENCE TO RELATED APPLICATIONS

This application claims priority to U.S. Provisional Patent Application No. 61/609,237, filed on Mar. 9, 2012, the entire contents of which are hereby incorporated by reference.

TECHNICAL FIELD

This application is directed towards ammunition articles ("articles") and methods for making the same, and, more particularly, towards a polymer cased ammunition ("PCA") article having a propellant cavity ("cavity") sized and shaped by being molded around a core pull ("core pull") that optimally corresponds to the desired propellant charge volume and shape ("propellant charge") whether the projectile ("projectile") travels faster than the speed of sound ("supersonic") or slower than the speed of sound ("subsonic").

BACKGROUND

Ammunition articles typically are supersonic and generate an audible sound when the projectile travels at a speed greater than 1,100 feet per second during flight to the target ("supersonic articles"). This sound can be disadvantageous in military or covert operations because it may reveal the location where the supersonic article was discharged and ruin the element of surprise. Furthermore, noise can be an issue in law enforcement and commercial applications which needs to be abated.

Subsonic ammunition articles ("subsonic articles") have been developed that do not produce the distinguishable audible sound associated with supersonic articles. Such articles typically have less muzzle flash, use oversized projectiles, use less powder volume and function in traditional gas operated weapons. The propellant charge usually is a small charge loaded in a large cavity or gun powder with a filler. Using a reduced propellant charge without sizing the cavity to the propellant charge leaves a partially filled cavity resulting in inconsistent propellant distribution, prohibits uniform ignition and significantly alters the burn profile. The reduced propellant charge may create lower pressures which makes consistent and complete case mouth obturation ("chamber sealing") difficult and makes it hard to get a clean burn of the propellant causing rapid fouling of the weapon. In some cases, subsonic articles do not produce sufficient port pressure to enable subsonic articles to cycle properly in gas operated weapons.

The PCA articles and associated methods for making the same set forth herein address the above referenced disadvantages associated with conventional subsonic articles and methods. PCA articles presented herein generally have a thermal polymer based material ("polymer") cartridge casing ("casing") that holds a projectile in the first end ("neck"), and has a cavity and a base cap ("base cap") attached to the casing second end. A subsonic PCA article may contain a core that is molded around a core pull containing a base cap, cavity sleeve, and a neck ("core sleeve" or "CS").

It should be noted that articles contained herein are designed to function in existing weapons interchangeable with existing ammunition articles with functionality and performance improved over existing subsonic ammunition articles.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein are PCA articles that may be supersonic or subsonic. The articles may have a) injection molded casings with the first end molded around the second end of a projectile that may be textured and may be tapered; b) a cavity sized by the core pull to the propellant charge; and c) a primed base cap, that may be molded metal in one or more embodiments that is attached to the casing second end. A tapered projectile trailing end provides a thicker/stronger casing neck and texturing provides proper neck tension without creating a "die-lock" condition and may reduce or eliminate the need for a casing neck. External ribs may be added to subsonic PCA casings to lighten and strengthen the casing walls. A supersonic PCA article may be converted to a subsonic PCA article. In one or more embodiments, a subsonic PCA article may have an overmolded core sleeve.

A method of making an ammunition article. The method includes providing a projectile having at least one portion that defines a texturing, injection molding in a mold a material around a core pull and a portion of the projectile to form a casing, and removing the core pull to form a propellant charge cavity within the casing.

According to one or more embodiments, a trailing end of the projectile about which material is molded around defines one of a boat tail or taper.

According to one or more embodiments, the casing defines a first end at which the projectile is molded around, and a second end, and the method further includes attaching a base cap to the second end.

According to one or more embodiments, injection molding a material includes injection molding one of a thermal polymer, ceramic, metal, or a composite.

According to one or more embodiments, the material in the step of injection molding a material includes one of a plasticizer, lubricant, molding agent, filler, thermo-oxidative stabilizers, flame-retardants, coloring agents, compatibilizers, impact modifiers, release agents, and reinforcing fibers.

According to one or more embodiments, the method includes loading a propellant charge in the cavity.

According to one or more embodiments, loading a propellant charge in the cavity comprises loading one of a gun powder or a composite of propellant materials that are substantially free of filler material and that occupy substantially all of the predetermined propellant charge volume.

According to one or more embodiments, the method includes preheating the projectile and molding into which the core pull is placed, and cycling heat in the mold including inductive heating.

According to one or more embodiments, injection molding around the core pull defines an area of increased thickness.

According to one or more embodiments, injection molding around the one of the boat tail or taper defines a seat against which the projectile abuts, and further wherein injection molding around the one of the boat tail or taper defines an area of increased thickness compared to a portion molded around a portion of the projectile that does not define one of a boat tail or taper.

According to one or more embodiments, the ammunition article is free of a neck portion about the projectile.

According to one or more embodiments, the mold defines one or more ribs and collars to thereby define corresponding ribs and collars on the casing after the step of injection molding in a mold.

According to one or more embodiments, the method includes inserting a sleeve into the propellant charge cavity to reduce the volume of the propellant charge cavity.

According to one or more embodiments, the method includes providing a base cap that is cold formed from metal or injection molded from polymer, ceramic, metal, or a composite material and into which a primer is inserted to ignite the propellant charge.

According to one or more embodiments, a method of making an ammunition article is provided. The method includes determining a desired propellant charge volume for a given ammunition article, determining one or more dimensions of a casing such that a cavity defined therein has a volume that substantially corresponds to the desired propellant charge volume, and forming the casing having the one or more dimensions.

According to one or more embodiments, the ammunition article has one of a predetermined length and caliber.

According to one or more embodiments, the diameter of the cavity generally corresponds to the diameter of a trailing end of the projectile.

According to one or more embodiments, the one or more dimensions includes at least one of an interior diameter and length of the cavity, and a cross-section of the casing.

According to one or more embodiments, a method of making a subsonic ammunition article is provided. The method includes providing a sleeve having a cavity and that is positioned proximal a projectile, and injection molding, in a mold, a material around the sleeve to form a casing.

According to one or more embodiments, the sleeve is molded at one station and the polymer based casing is molded around the sleeve in a mold at a second station According to one or more embodiments, a primer is inserted in a primer seat at a trailing end of the casing, a propellant charge is loaded in the cavity through a neck of the ammunition article, and inserting the projectile into the neck.

According to one or more embodiments, a method of making an ammunition article is provided. The method includes injection molding a polymer material around a core pull to form a propellant casing such that the core pull defines a volume of the casing when removed for containing a propellant charge volume that corresponds to a desired ammunition charge.

According to one or more embodiments, the method includes injection molding around a projectile.

According to one or more embodiments, the casing defines a first end at which the projectile is molded around, and a second end. The method further includes attaching a base cap to the second end.

According to one or more embodiments, the method includes providing a propellant charge inside of the casing and a further including providing a primer for igniting the propellant charge.

According to one or more embodiments, the method includes molding the base cap from a polymer.

According to one or more embodiments, the method includes providing a metallic casing into which the core pull is inserted into before injection molding.

According to one or more embodiments, the propellant charge occupies substantially all of the predetermined propellant charge volume.

According to one or more embodiments, the propellant charge is substantially free of a filler material.

According to one or more embodiments, the propellant charge is one or gun powder and cordite and the propellant charge volume corresponds to a subsonic ammunition charge for a given projectile.

According to one or more embodiments, the method includes providing a metallic outer casing that has a first end configured for receiving a projectile and a second end configured for receiving a base cap, inserting the core pull through the first end into the casing, and injection molding through a gate defined in the second end.

According to one or more embodiments, the method includes providing a metallic outer casing that has a first end configured for receiving a projectile and a second end configured for receiving a base cap, inserting the core pull through the first end into the casing, and injection molding through a gate defined in the casing.

According to one or more embodiments, the method includes providing a metallic outer casing that has a first end configured for receiving a projectile and a second end configured for receiving a base cap, inserting the core pull through the first end into the casing, and injection molding through a gate defined in the core pull.

According to one or more embodiments, the gate is defined in a portion of the core pull proximal the first end of the casing.

According to one or more embodiments, the core pull defines a plurality of gates.

According to one or more embodiments, a method of making a subsonic ammunition article is provided. The method includes injection molding a polymer material around a core pull to form a propellant casing of an increased thickness such that the core pull defines a volume of the casing when removed for containing a propellant charge that corresponds to a subsonic ammunition charge.

According to one or more embodiments, the method includes removing the core pull such that the core pull volume defines the casing volume.

According to one or more embodiments, the method includes injection molding around a projectile.

According to one or more embodiments, the casing define a first end at which the projectile is molded around, and a second end, and the method further includes attaching a base cap to the second end.

According to one or more embodiments, the method includes providing a propellant charge inside of the casing and a further including providing a primer for igniting the propellant charge.

According to one or more embodiments, the method includes molding the base cap from a polymer.

According to one or more embodiments, the method includes providing a metallic casing into which the core pull is inserted into before injection molding.

According to one or more embodiments, the method further includes providing a metallic casing that has a first end configured for receiving a projectile and a second end configured for receiving a base cap, inserting the core pull through the first end into the casing, and injection molding through a gate defined in the second end.

According to one or more embodiments, the method includes providing a metallic casing that has a first end configured for receiving a projectile and a second end configured for receiving a base cap, inserting the core pull through the first end into the casing, and injection molding through a gate defined in the casing.

According to one or more embodiments, the method includes providing a metallic casing that has a first end configured for receiving a projectile and a second end configured for receiving a base cap, inserting the core pull through the first end into the casing, and injection molding through a gate defined in the core pull.

According to one or more embodiments, the gate is defined in a portion of the core pull proximal the first end of the casing.

According to one or more embodiments, a method of making an ammunition article is provided. The ammunition article is of the type having a casing that defines a volume therein. The method includes determining a desired propellant charge volume for a given ammunition article, determining one or more dimensions of the casing such that the casing volume substantially corresponds to the desired propellant charge volume, and forming the casing having the one or more dimensions.

According to one or more embodiments, the ammunition article has one of a predetermined length and caliber.

According to one or more embodiments, the ammunition article is a subsonic ammunition article.

According to one or more embodiments, the diameter of the casing volume generally corresponds to the diameter of a projectile to which the casing carries.

According to one or more embodiments, the one or more dimensions includes one of the interior diameter of the casing, the length of the casing, and the cross-section of the casing.

According to one or more embodiments, a method of making an ammunition article having a casing including a sidewall that defines a casing volume therein is provided. The method includes determining a desired propellant charge volume for a given ammunition article, determining a thickness of the casing sidewall such that the casing volume substantially corresponds to the desired propellant charge volume, and forming the casing having the determined thickness.

According to one or more embodiments, an ammunition article is provided. The article includes a casing having a first end that carries a projectile and a second end that carries a base cap, and a portion polymer within the casing, the portion of polymer defining a volume therein that contains a propellant charge.

According to one or more embodiments, the propellant charge corresponds to a subsonic ammunition charge.

According to one or more embodiments, the polymer within the casing is formed by injection molding a polymer material around a core pull such that the core pull defines a volume of the casing when the core pull is removed.

According to one or more embodiments, injection molding a polymer material comprises injection molding through a gate defined in the base cap.

According to one or more embodiments, injection molding a polymer material comprises injection molding through a gate defined in the casing.

According to one or more embodiments, injection molding a polymer material comprises injection molding through a gate defined in the casing.

According to one or more embodiments, the casing is one of metal and a polymer.

According to one or more embodiments, an ammunition article is made according to a process that includes determining a desired propellant charge volume for a given ammunition article, determining a thickness of the casing sidewall such that the casing volume substantially corresponds to the desired propellant charge volume, and forming the casing having the determined thickness.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings:

FIGS. 3A, 3B, 3C, and 3D depict components of a subsonic PCA article with a FIG. 6 projectile according to one or more embodiments disclosed herein;

DETAILED DESCRIPTION

The presently disclosed invention is described with specificity to meet statutory requirements. However, the description itself is not intended to limit the scope of this patent; rather, the inventor(s) have contemplated that the claimed invention might also be embodied in other ways, to include different elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Figure 1A:
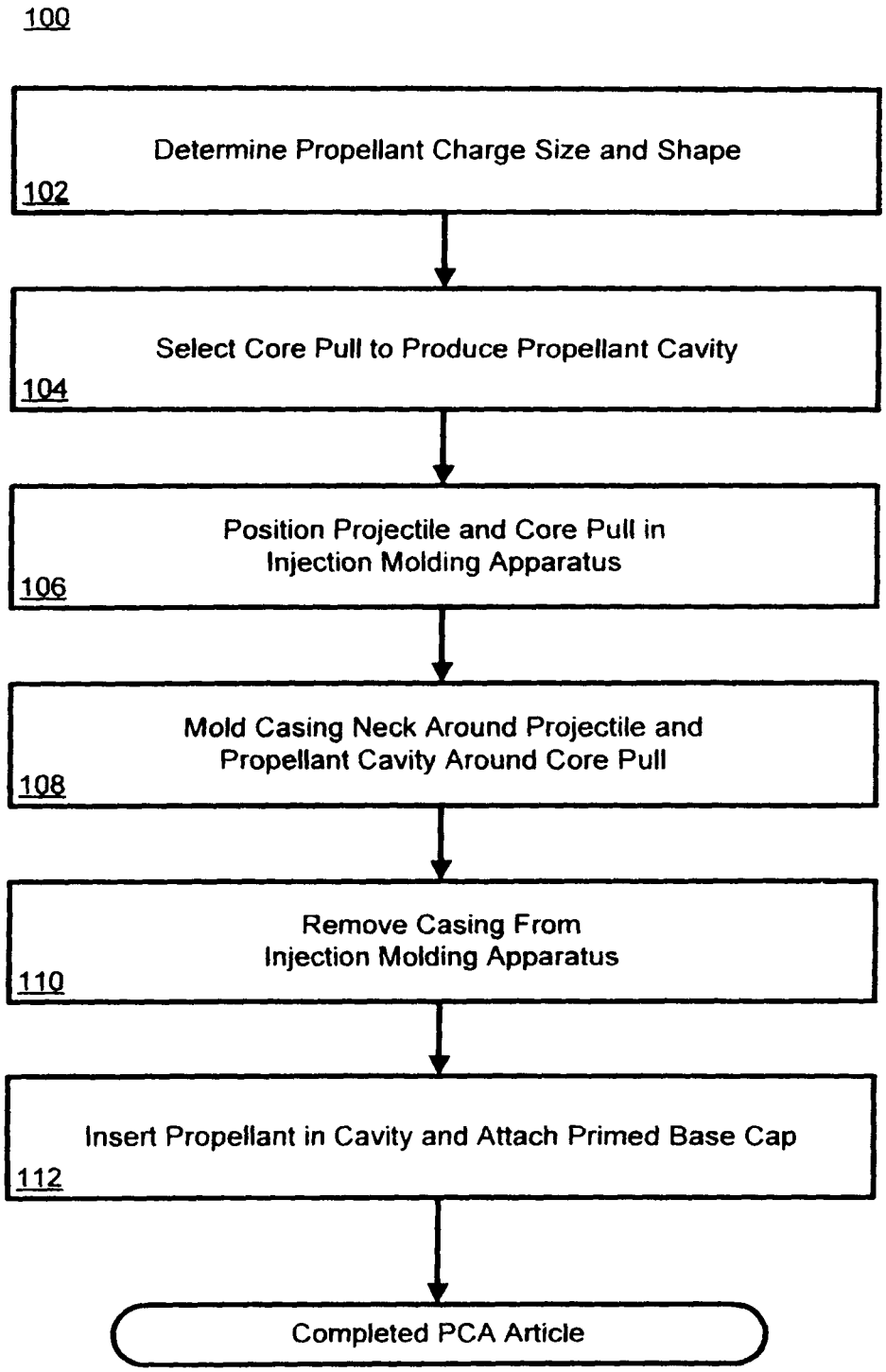
FIGS. 1A and 1B are flow charts depicting one or more methods for making an article according to one or more embodiments disclosed herein.
Figure 1B:
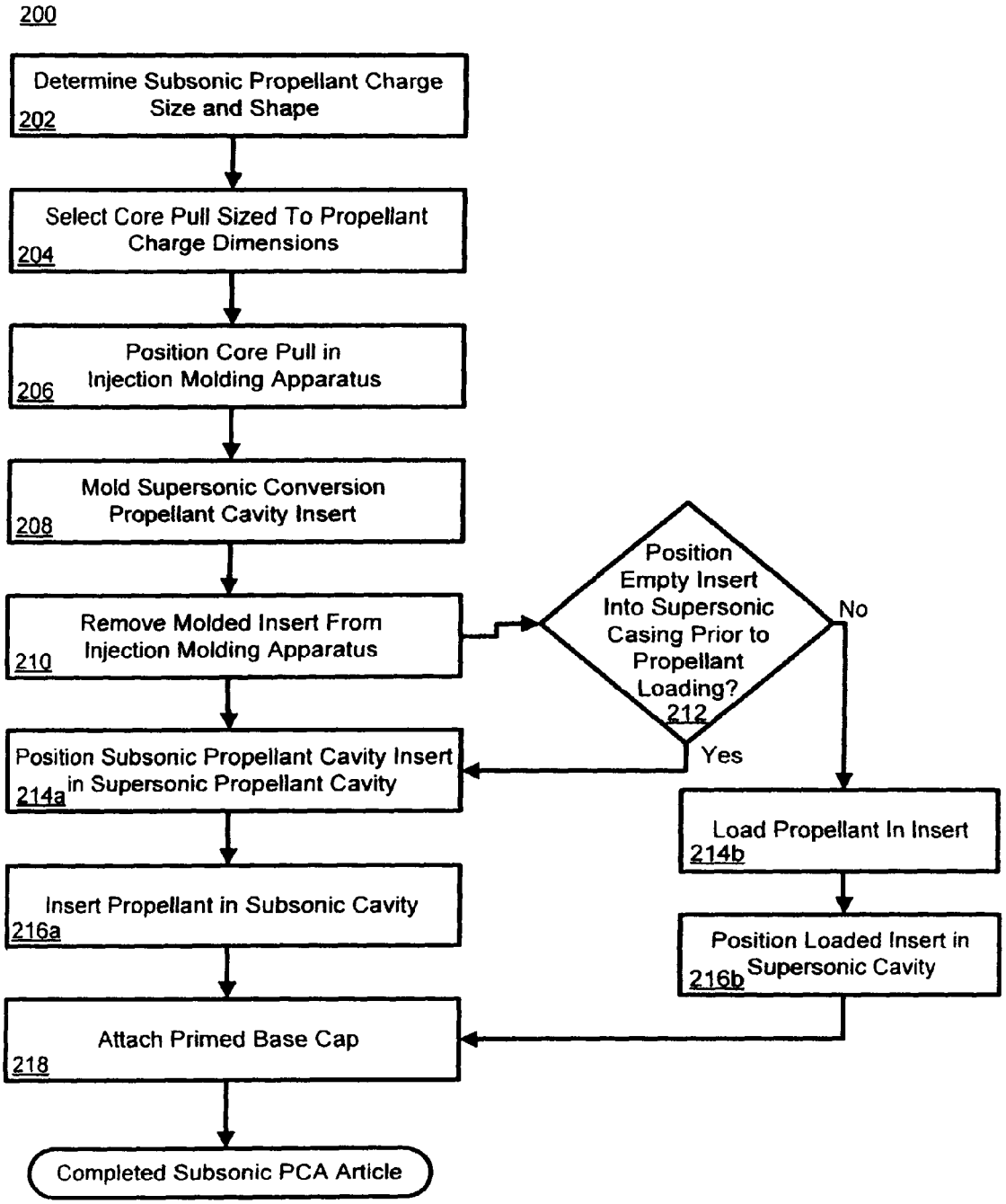

Provided herein are one or more methods for making an article and associated articles. One or more steps are provided below and in the flow chart of FIG. 1, though many steps are optional and not limiting to the disclosure provided herein. As illustrated in FIG. 1, one or more methods for making an article are provided 100. The one or more methods 100 may be applicable for any size and style article for small arms. The one or more methods 100 are particularly advantageous for manufacturing subsonic articles. The one or more methods 100 include several steps beginning with 102 which include determining the propellant charge composition, volume, and shape needed to achieve the ballistics required for a given PCA article. Step 104 of method 100 includes selecting a core pull that will produce a cavity corresponding to the propellant volume and shape required. Step 106 of method 100 includes inserting the projectile in a mold and seating the core pull in the mold against the base of the projectile. Step 108 of method 100 includes injecting polymer through a gate in the mold cavity and around the core pull and the projectile trailing end, thereby, creating a casing molded around a portion of the projectile and having a cavity sized and shaped to receive the required propellant charge when the core pull is removed. If one desires an article having a smaller cavity to accommodate a reduced propellant charge volume, a smaller core pull would be selected. For example, if one desires a cavity with a 5 millimeter inner diameter instead of a 9.5 millimeter inner diameter, a core pull having a 5 millimeter diameter would be selected. In this manner, the mold cavity and core pull define the cavity wall thickness. Step 110 of method 100 includes removing the core pull and casing from the mold. Step 112 of method 100 includes loading the propellant charge in the cavity which may be gun powder or other appropriately configured materials that are substantially free of a filler material. In this manner, the propellant charge can be of high quality material for improved ignition characteristics and the propellant charge will occupy substantially all of the cavity volume. As used herein, "substantially all" means a cavity volume in which any unfilled space in the cavity after the propellant charge has been loaded is small in portion. Finally, step 114 of method 100 includes attaching a primed base cap to the second end of the casing which completes the PCA article.

FIG. 1 also illustrates one or more methods 200 for making an article. The one or more methods 200 include converting a supersonic PCA casing made pursuant to one or more methods 100 contained in FIG. 1 to a subsonic PCA casing by inserting a sleeve in the supersonic PCA cavity; thereby, converting the cavity from supersonic to subsonic. The sleeve whether injection molded or otherwise formed will reduce the cavity to the desired volume and shape once inserted. Like step 102 of method 100, step 202 of method 200 includes determining the desired propellant charge volume and shape which takes into consideration the type of ammunition powder or charge, the size and weight of a projectile, and other factors. Like step 104 of method 100, step 204 of method 200 includes determining the cavity dimensions that correspond to the desired propellant charge volume and shape and selecting a core pull that will produce such dimensions. For example, if a subsonic article is desired whereby the projectile muzzle velocity is less than 1,100 feet per second (340 meters per second), the cavity dimensions can be selected to match the propellant charge volume and shape needed to achieve the desired performance characteristics. In one or more embodiments, the cavity sidewall may be uniform throughout any given cross-section of the cavity, whereas, in one or more additional embodiments, the cavity may not be uniform and may instead take on any optimally configured or desired cross-section. For example, the cavity sidewall may include a plurality of stepped-up and stepped-down portions or other desired configuration. Like steps 106 through 110 of method 100, steps 206 through 210 of method 200 include one or more methods of positioning the core pull in a mold designed to produce the cavity Insert, forming the insert by injecting molding polymer around the core pull and removing the cavity Insert from the mold. Step 212 includes one or more methods of positioning the cavity insert in the method 100 PCA cavity. Like step 112 of method 100, steps 214 and 216 of method 200 include inserting propellant charge in the cavity Insert and attaching a primed base cap to the second end of the casing; thereby, completing the method 200 PCA subsonic article. As an alternative, the propellant charge may be loaded before the cavity sleeve is loaded in the casing with a combustible membrane securing the propellant at each end.

Figure 2:
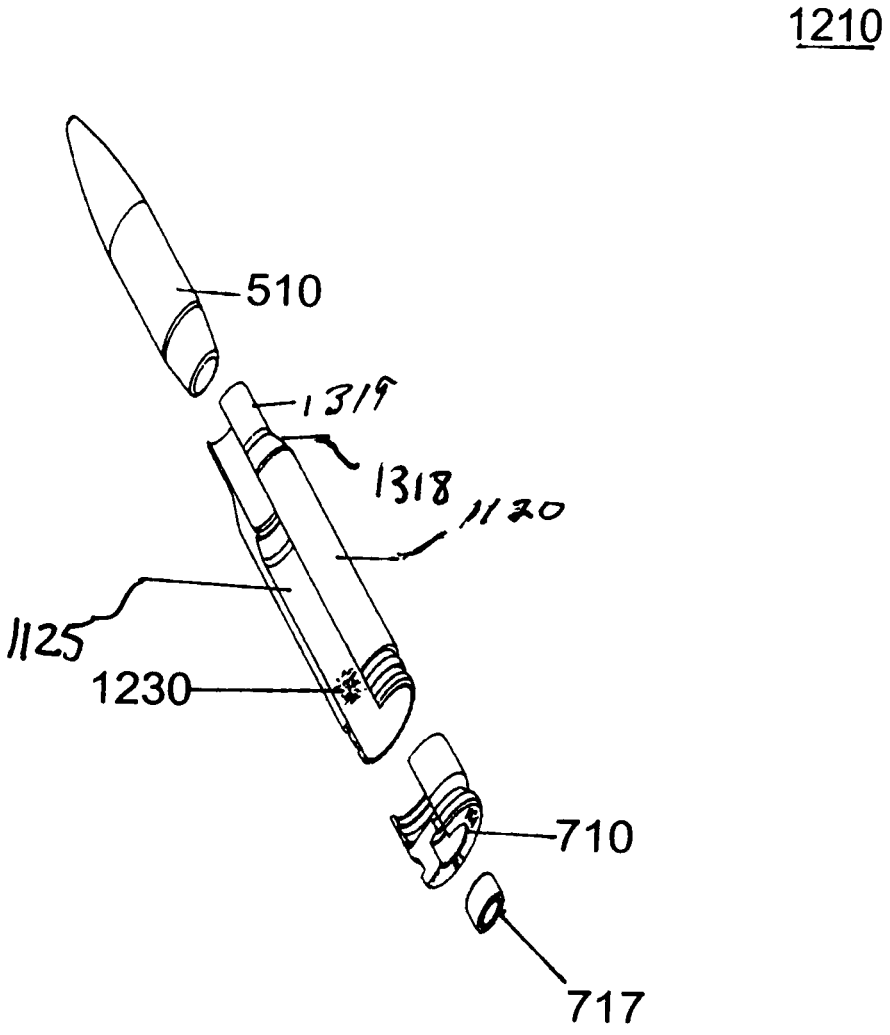
FIG. 2 depicts components of a supersonic PCA article with a FIG. 5 projectile according to one or more embodiments disclosed herein.

FIG. 2 illustrates supersonic PCA article 1210 components. Casing 1118 is a structural supersonic component with a first end into which the projectile 510 is seated and cavity 1120 into which the propellant charge is loaded and to which a primed base cap 710 is attached, thereby, completing the PCA. PCA casings must have the ability to deform under high ballistic pressures ("ductility") and maintain reliable case integrity under extreme temperatures (negative 45 degrees to 165 degrees Fahrenheit) without cracking or splitting.

Figure 3A:
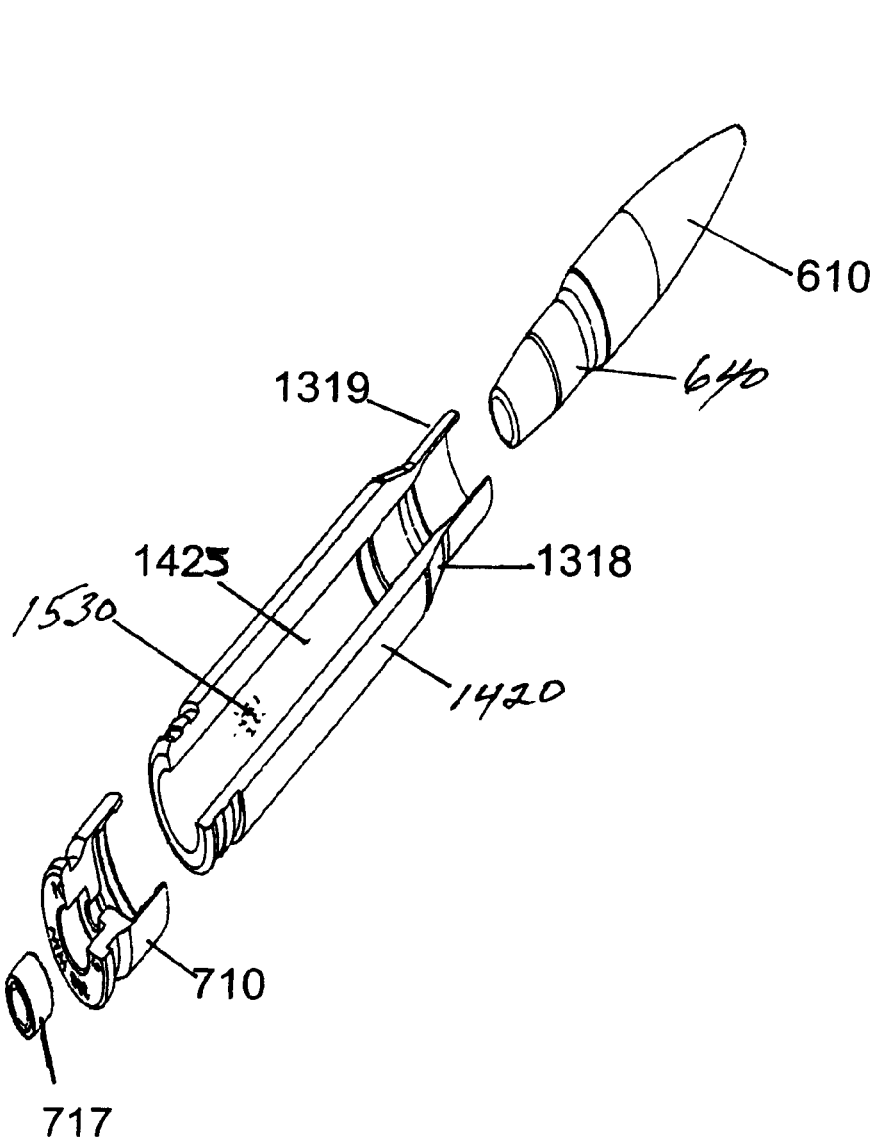

FIG. 3A illustrates subsonic PCA article 1510 components which are similar to FIG. 2 components except that casing 1418 is thicker and the cavity has a smaller diameter than FIG. 2 and projectile 610 used herein has a tapered trailing end.

Figure 3B:
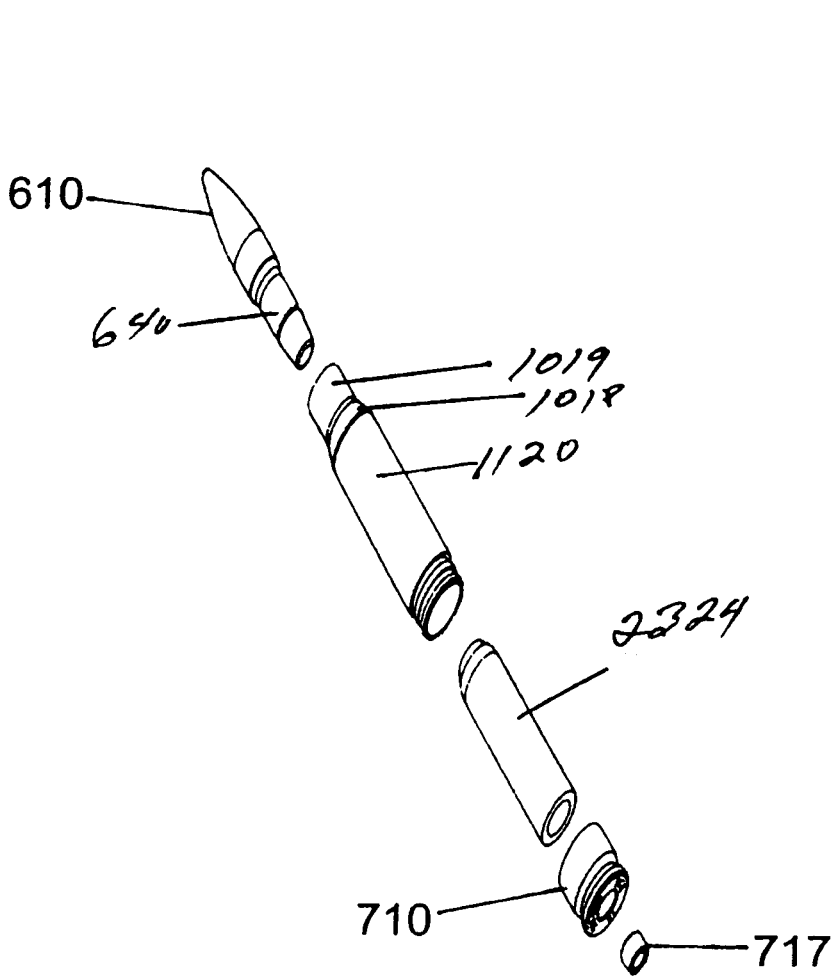

FIG. 3B illustrates subsonic PCA article 2010 components which are similar to FIG. 3 components except that casing 2020 has external ribs.

Figure 3C:
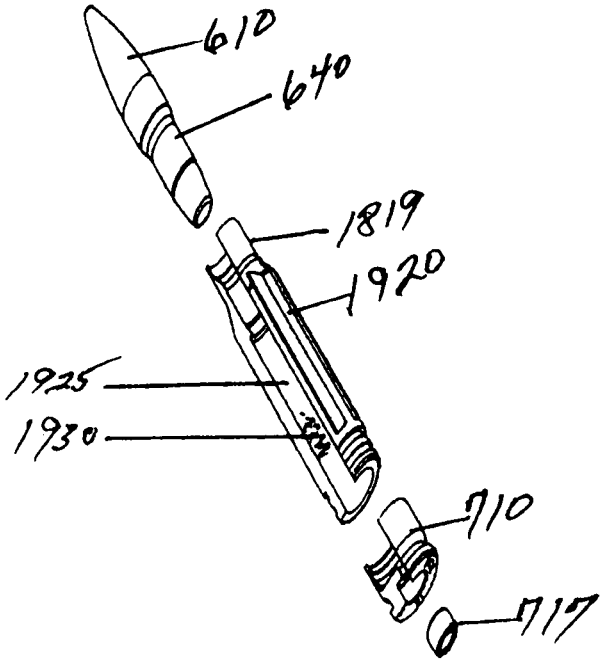
Figure 30:
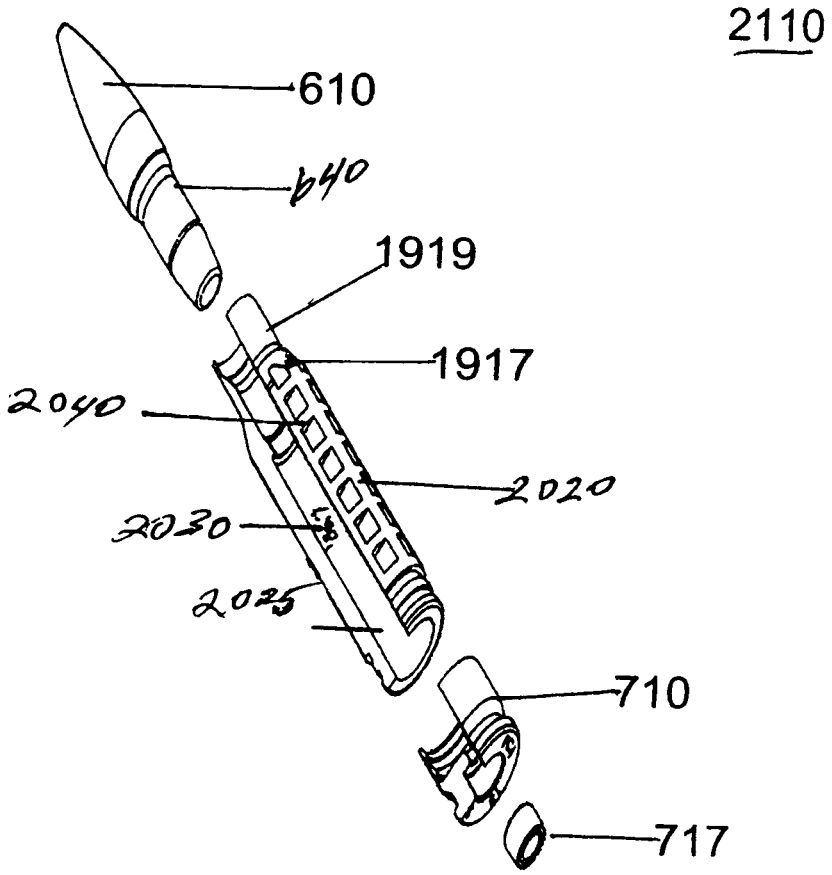

FIG. 3C illustrates subsonic PCA article 2110 which is article 2010 with external collars around the casing as well as external ribs.

FIG. 3D illustrates subsonic article 2410 components which include a supersonic PCA casing 1118 converted to a subsonic PCA casing 2318 by placing cavity insert 2320 in cavity 1120, loading the propellant charge therein and attaching a primed base cap to the casing second end.

Figure 4:
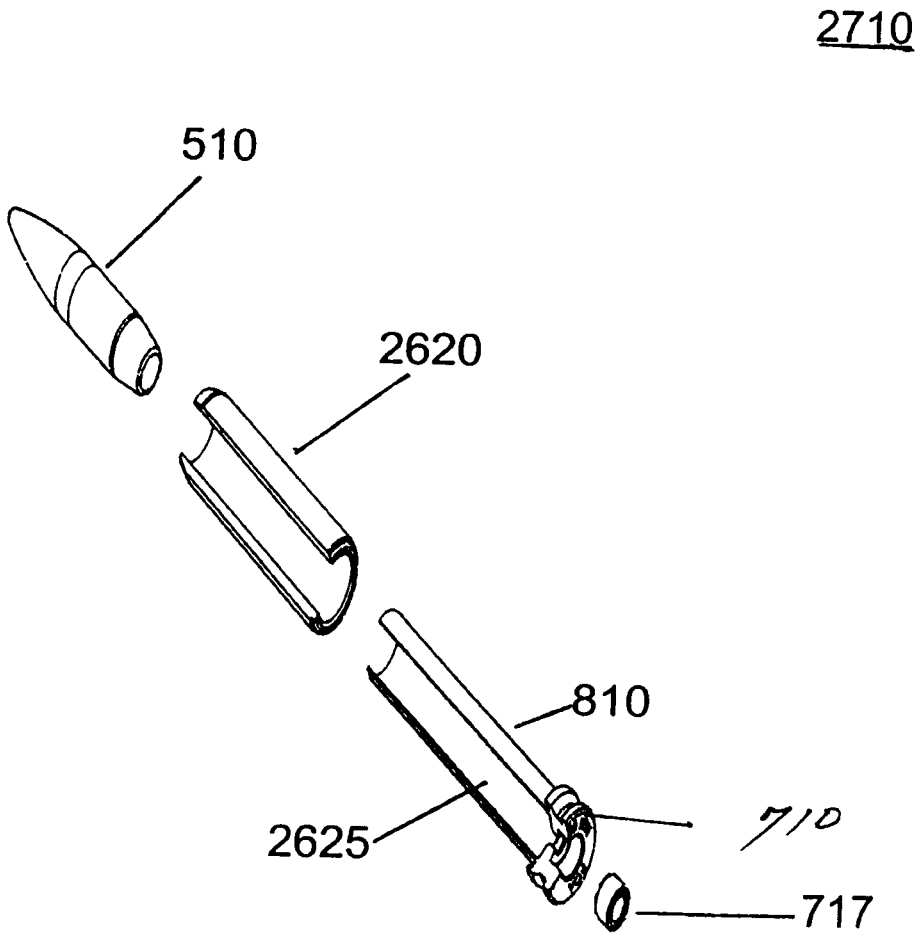
FIG. 4 depicts components of a subsonic PCA article with a core sleeve according to one or more embodiments disclosed herein.

FIG. 4 illustrates subsonic PCA article 2410 components which include a polymer casing molded around a core sleeve, a primer 815 inserted in the primer cavity at the casing second end, and projectile 510 or 610 inserted in the neck after the propellant charge is loaded through the neck.

Figure 5:
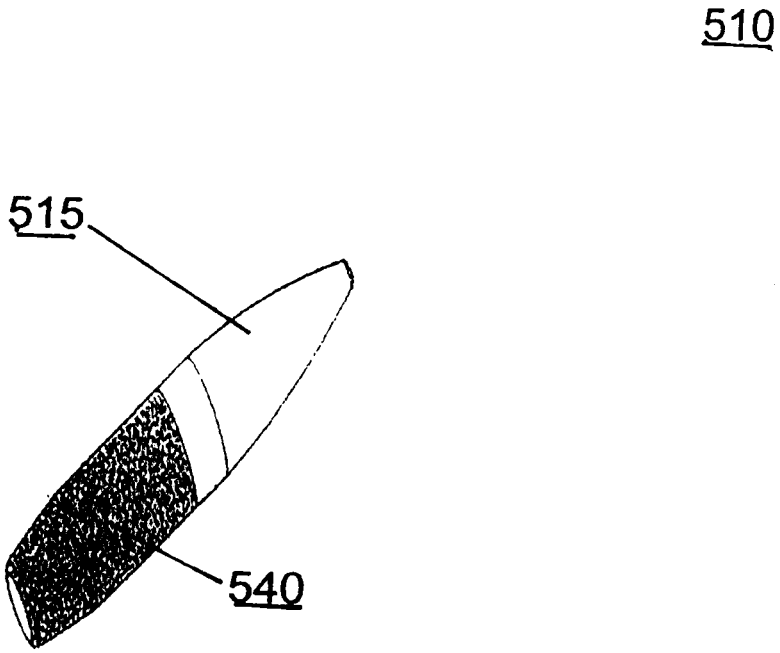
FIG. 5 depicts a .308 cal. full metal jacket boat tail projectile according to one or more embodiments disclosed herein.
Figure 6:
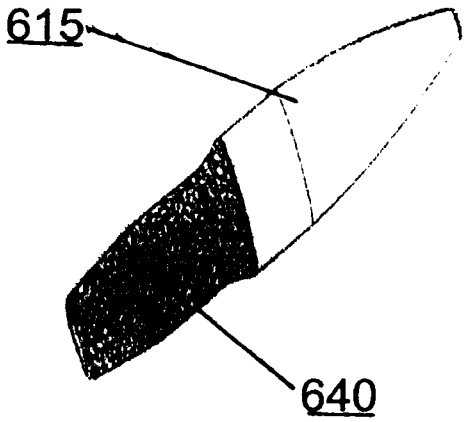
FIG. 6 depicts FIG. 5 with a tapered trailing end ("projectile tapered trailing end" or "PTTE") according to one or more embodiments disclosed herein.

FIG. 5 illustrates a projectile 510 which is attached to the first end of a casing by one of several methods. As illustrated herein, the first end of the casing is overmolded around the projectile trailing end. Although various size projectiles may be used in supersonic PCA articles, FIG. 5 depicts a .308 cal 220 grain full metal jacket boat-tail projectile. Unless the projectile trailing end is tapered as depicted in FIG. 6, a boat-tail projectile is advantageously provided for use in PCA articles because the casing area molded around the projectile trailing end creates a seat ("projectile seat") that prevents the projectile from compressing into the cavity. The projectile trailing end is textured except for the neck area as a method of creating appropriate neck tension when a casing is overmolded the projectile trailing 640. Greater tension may require heavier texturing and less tension requires finer texturing. The neck area remains untextured to reduce stress on the neck/shoulder joint. Overmolding a projectile with canneluring creates a die-lock condition because polymer fills the canneluring groove during the overmolding process which causes neck failure when the PCA article is fired. A secondary benefit of texturing the projectile trailing end 640 may be greater stability in flight. The length of the overmolded textiled trailing end in the shoulder and cavity ("projectile seat") may render the neck unnecessary to hold the projectile and provide necessary pull tension. Furthermore, head space is determined by the shoulder and not the neck for rifle ammunition articles. Reducing or eliminating the casing neck will reduce or eliminate instances of neck failure in PCA articles.

FIG. 6 illustrates projectile 610 which is FIG. 5 with a tapered trailing end to provide improved strength in the casing neck and neck/shoulder joint with about 2 millimeters of the projectile trailing end at the mouth of the casing unchanged and overmolded.

Figure 7:
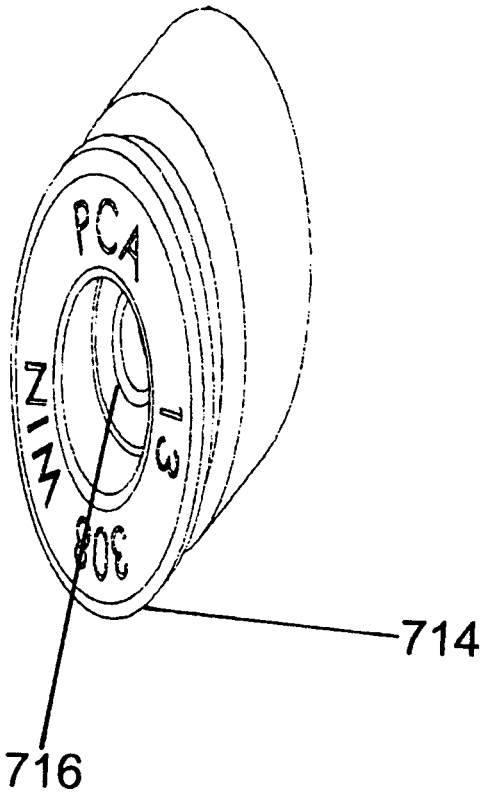
FIG. 7 depicts a cold formed or a molded base cap according to one or more embodiments disclosed herein.

FIG. 7 illustrates base cap 710 that is attached to the second end of a casing. The one or more methods may also include cold forming or injection molding the base cap from polymer, metal or a composite material. The base cap has a first end with internal grooves 712 matching the ridges on the exterior of the casing trailing end and an exterior ejector ring 714 at the trailing end for extraction purposes. The bottom of the base cap has a primer cavity 716 into which a primer 717 is seated and a flash-hole 718 through which the propellant charge propellant charge is ignited when the primer is activated.

Figure 8:
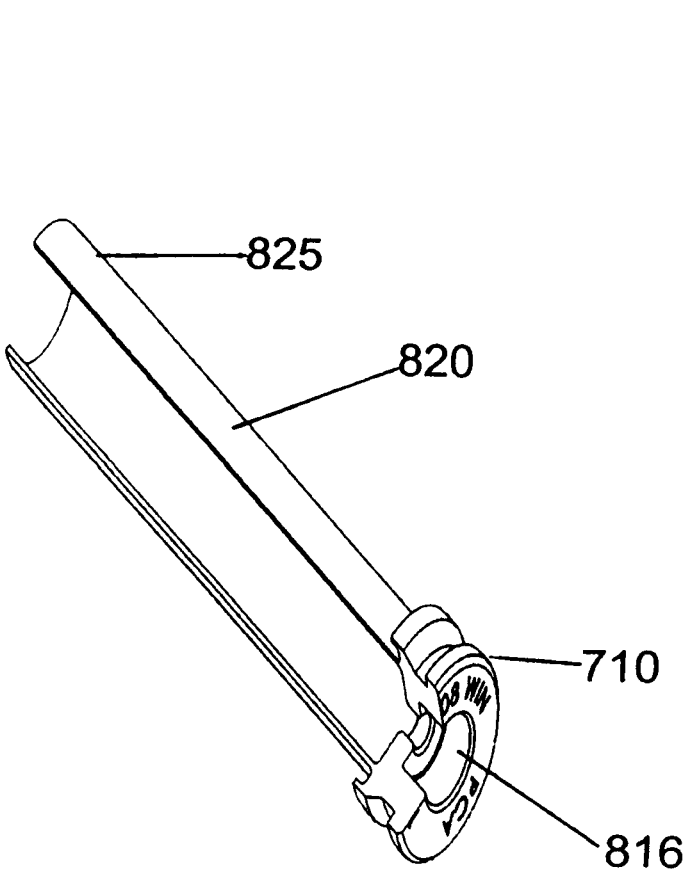
FIG. 8 depicts an injected molded core sleeve according to one or more embodiments disclosed herein.

FIG. 8 illustrates a molded core sleeve including a FIG. 7 base cap without grooves that is seamlessly attached to a cavity sleeve and neck. The neck may be short as in the case of FIG. 16. There may be several rings evenly spaced along the overmolded which may also be textured. The base may have a ledge which together the rings and texturing prevent the polymer casing from sliding on the core sleeve or separating upon ejection. The cavity section of the sleeve is shaped and sized to match the propellant charge and the casing first end is shaped to receive a FIG. 5 or 6 projectile which may or may not be textured.

Figure 9:
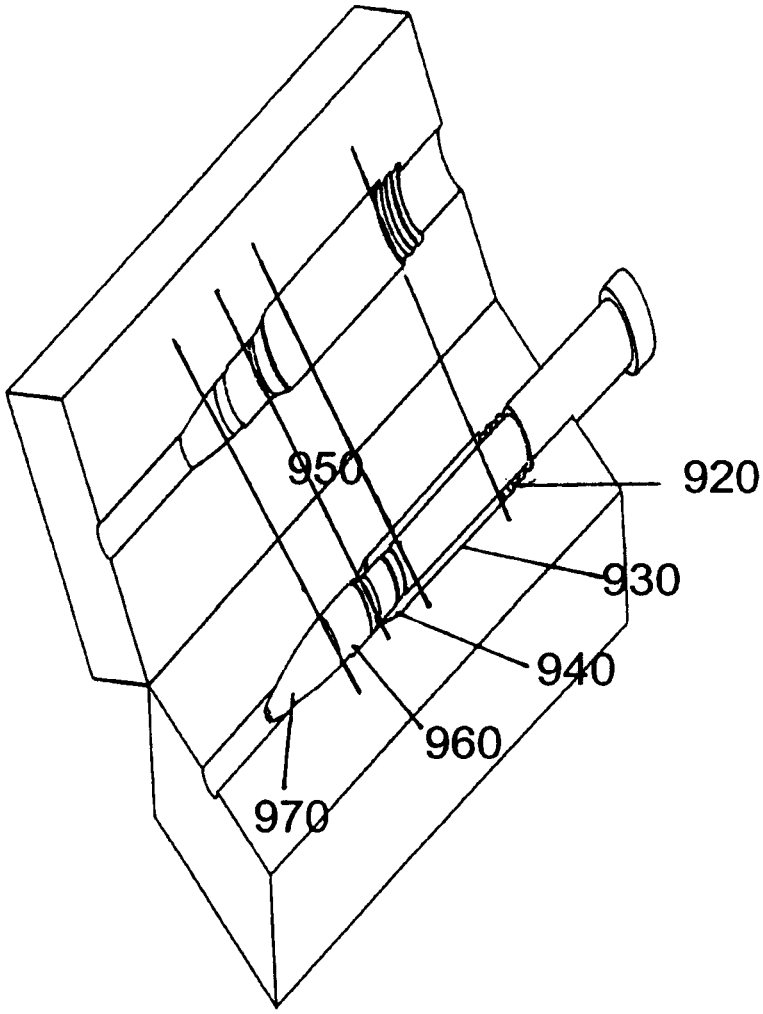
FIG. 9 depicts a mold for molding a polymer casing that is segmented for heat cycling according to one or more embodiments disclosed herein.

FIG. 9 illustrates a universal mold 910 for producing PCA casings and is divided into three sections: the neck area 960, shoulder area 940, cavity area 930, and case/base connection 920. Molding temperature may need to be the highest in the areas where the casing wall is the thinnest and lowest where the casing wall is the thickest, therefore, the molding temperature at the neck need to be the highest, the shoulder molding temperature needs to be the lowest and the cavity molding temperature needs to be moderately high. The mold needs to be segmented into three heat zones to accommodate the differing temperature requirements ("heat cycling") of polymer as it enters the mold through a gate in the cavity at the casing trailing end and moves around the core pull and the projectile trailing forward to the mouth of the neck which is the thinnest casing wall. In one or more experiments, about five percent (5%) of the casing outer layer where the material enters the mold ("shear layer") has little strength and radiates through the casing length. For example, a subsonic shear layer of 5% at the cavity is 22% of the neck wall unless a projectile tapered projectile is used. Heating the projectile to prevent it from becoming a heat-sink and prematurely cooling the polymer may be advantageous to avoid neck failure. Finally, intensive heating may be required to achieve proper temperature in the three mold segments which strengthens casing wall.

Figure 10:
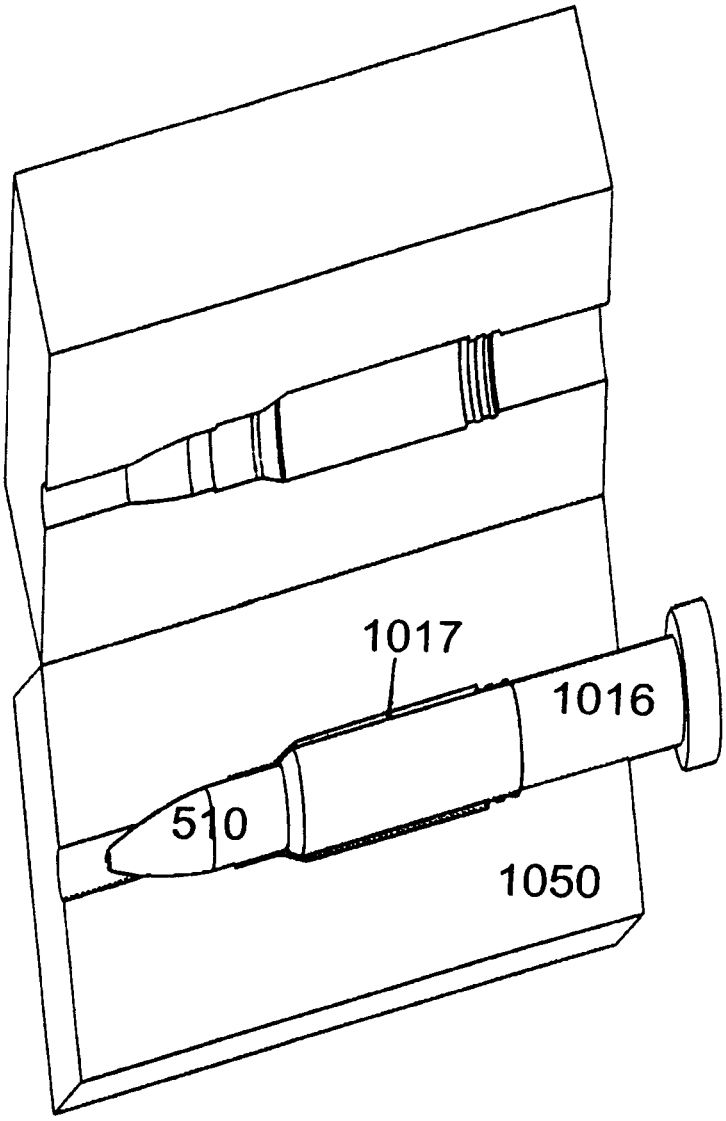
FIG. 10 depicts FIG. 5 projectile and a core pull inserted in a mold for making a supersonic casing according to one or more embodiments disclosed herein.
Figure 11:
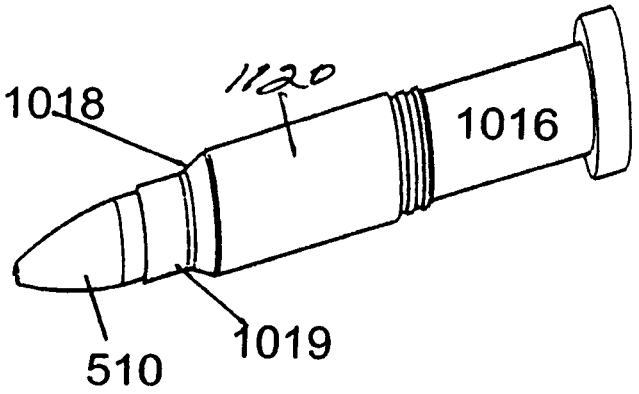
FIG. 11 depicts a casing made in the FIG. 10 according to one or more embodiments disclosed herein.
Figure 12:
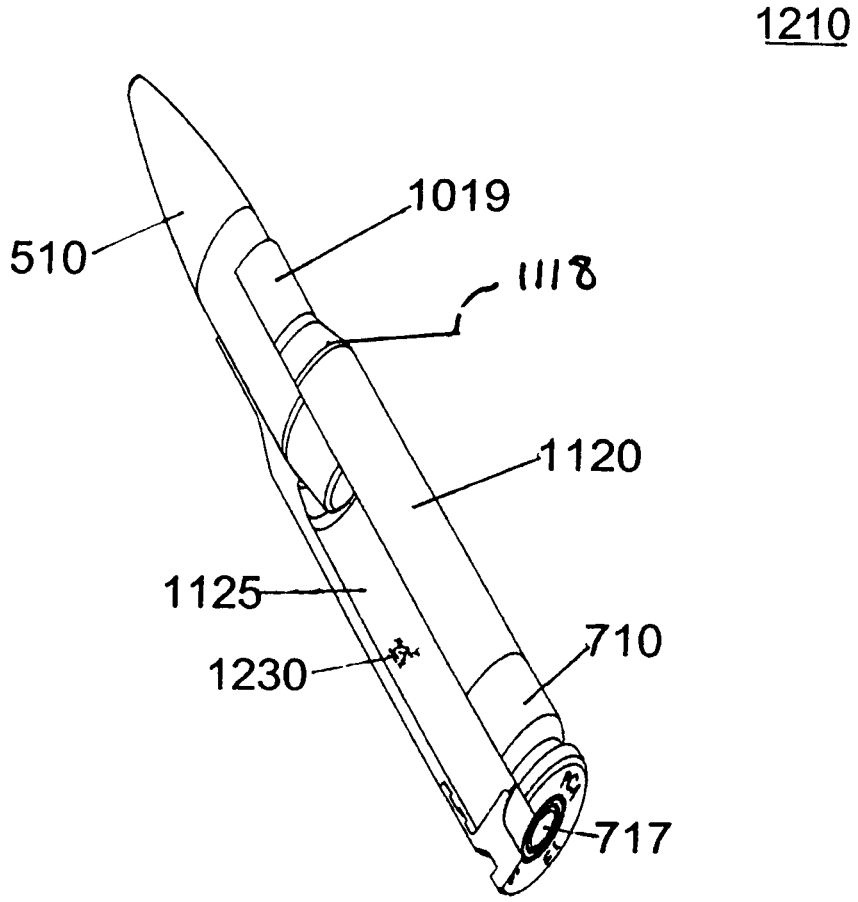
FIG. 12 depicts a supersonic PCA article made with the FIG. 11 casing according to one or more embodiments disclosed herein.

FIGS. 10 through 12 illustrate supersonic PCA article 1210 from an associated mold 1050 according to one or more embodiments made according to the one or more methods 100. FIG. 10 illustrates an open mold 1050 with a projectile seat and a cavity profile of the casing outer dimensions ("mold cavity"). A projectile 510 is positioned in the projectile seat 1015 and a core pull 1016 is inserted in the mold and seated against the textured trailing end 540 of the projectile 510. Polymer is injected through one or more gates in the mold and flows in the mold cavity 1017 around the core pull forming the cavity and around the projectile trailing end forming the shoulder 1018 and neck 1019. FIG. 11 illustrates casing 1120 molded in FIG. 10 which reveals the cavity 1125 when the core pull 1016 is removed. FIG. 12 illustrates casing 1120 with the propellant charge 1230 loaded in the cavity 1125 and a primed base cap 710 attached to the casing trailing end, thereby, completing the supersonic PCA article 1210.

Figure 13:
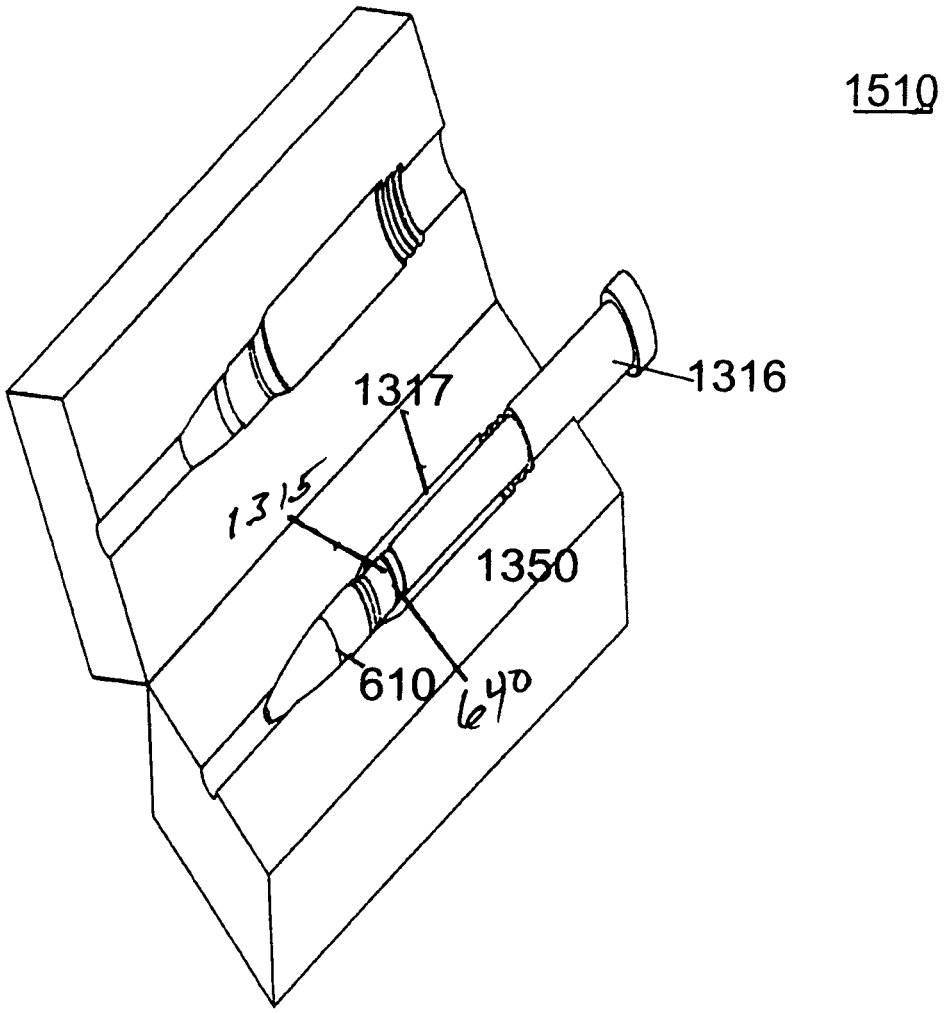
FIG. 13 depicts FIG. 6 projectile and a core pull inserted in a mold for making a subsonic casing according to one or more embodiments disclosed herein.
Figure 14:
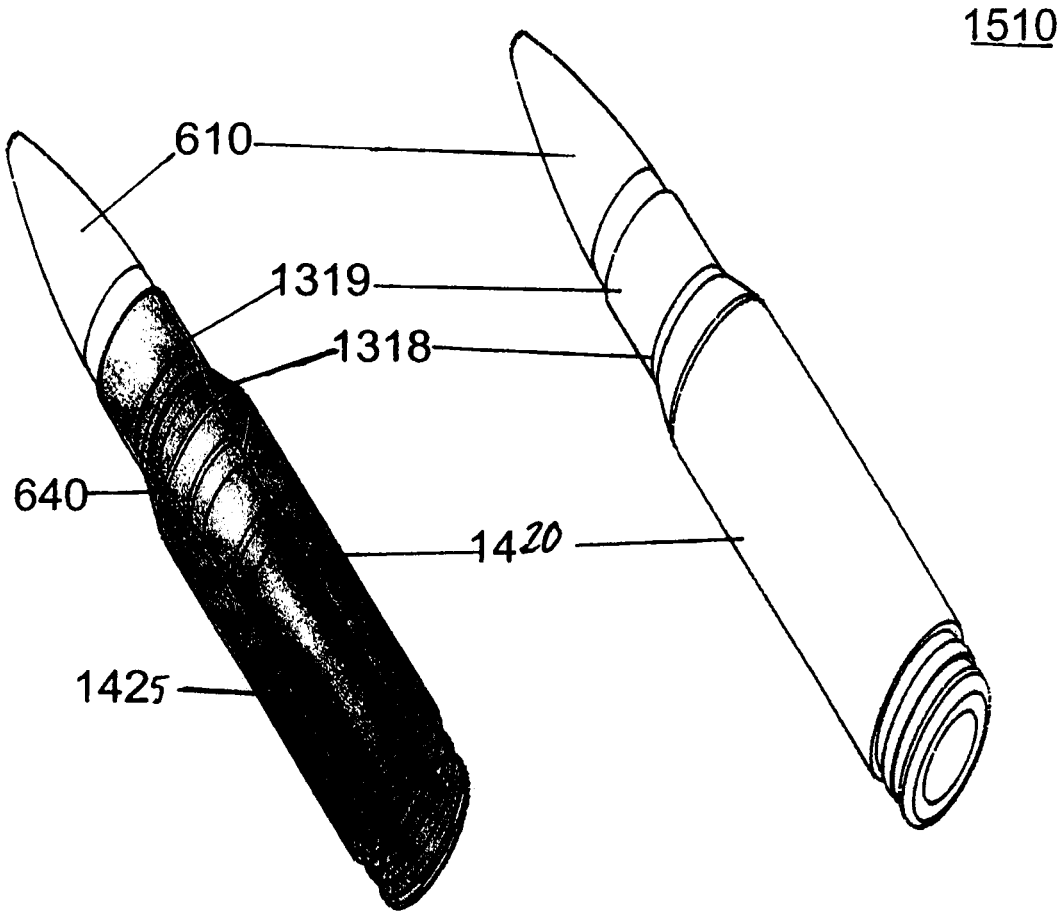
FIG. 14 depicts a casing made in the FIG. 13 according to one or more embodiments disclosed herein.
Figure 15:
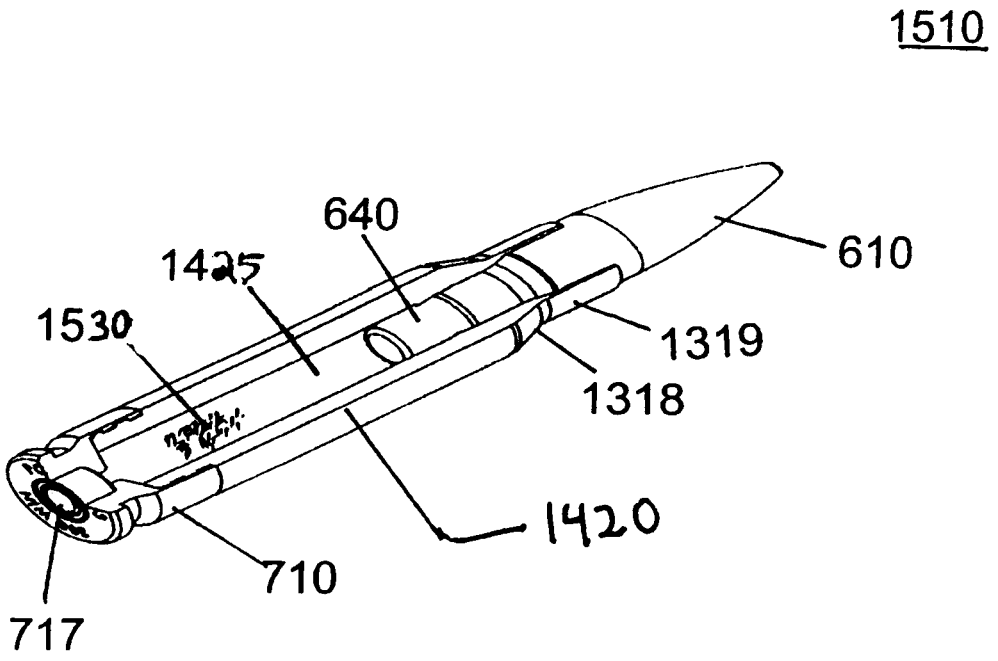
FIG. 15 depicts a subsonic PCA article made with the FIG. 14 casing according to one or more embodiments disclosed herein.

FIGS. 13 through 15 illustrate subsonic PCA article 1510 from an associated mold 1350 according to one or more embodiments made according to the one or more methods 100. FIG. 13 illustrates an open mold 1350 with a projectile seat 1315 and mold cavity 1317. A projectile 610 is positioned in the projectile seat 1315 and a core pull 1316 is inserted in the mold and seated against the textured trailing end 640 of the projectile 610. Polymer is injected through one or more gates in the mold and flows in the mold cavity 1317 around core pull 1316 forming the cavity and around the projectile trailing end, forming the shoulder 1318 and neck 1319. FIG. 14 illustrates a subsonic casing 1420 molded in FIG. 13 which reveals the propellant cavity 1425. FIG. 15 illustrates casing 1420 with a propellant charge 1530 loaded in the cavity 1425 and a primed base cap 710 attached to the casing trailing end, thereby, completing subsonic PCA article 1510 with a smaller cavity and propellant charge but a thicker cavity wall.

Figure 16:
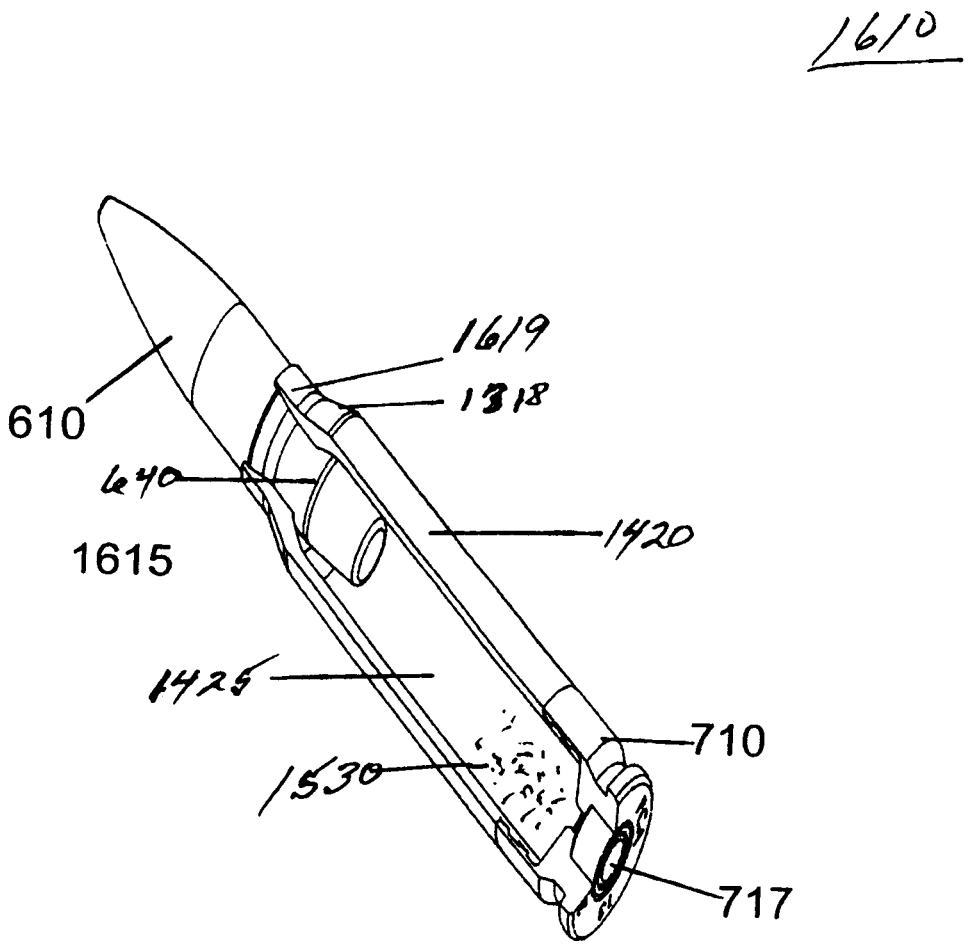
FIG. 16 depicts a supersonic PCA article FIG. 12 or a subsonic PCA article FIG. 15 with a short neck casing according to one or more embodiments disclosed herein.

FIG. 16 illustrates subsonic PCA article 1610 which is the same as PCA article 1510 except the casing neck 1619 is short because the polymer projectile seat 1315 provides the necessary neck tension and projectile stability.

Figure 17:
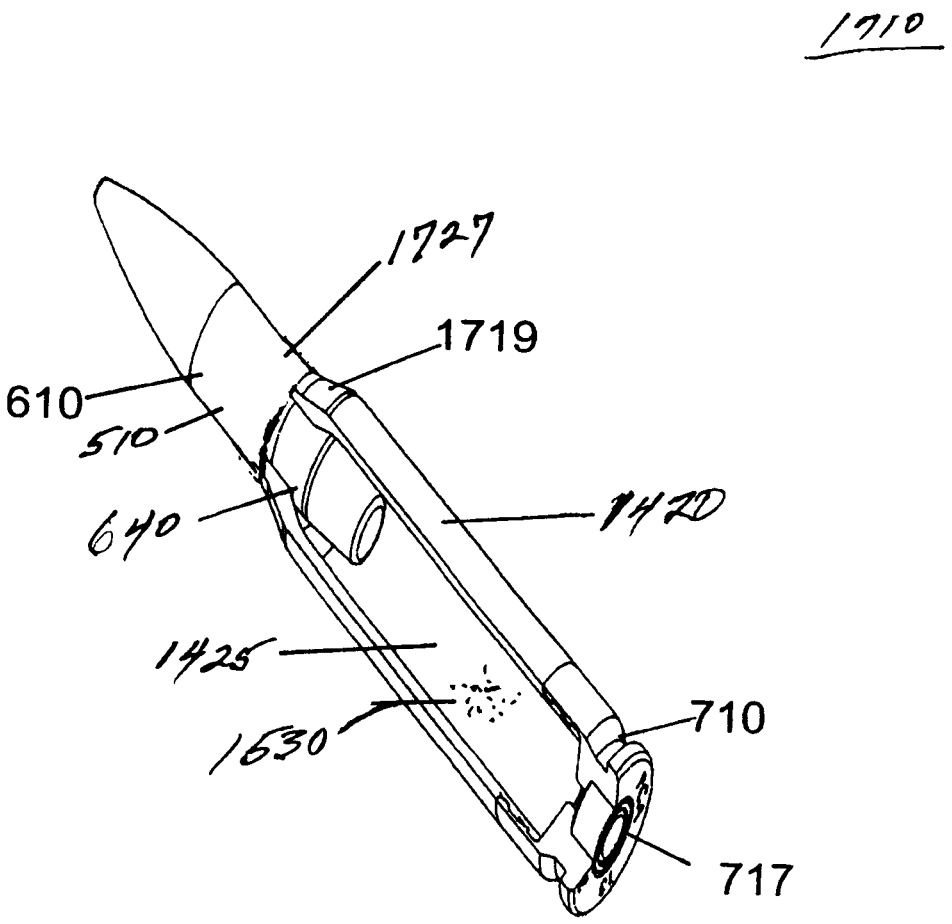
FIG. 17 depicts a supersonic PCA article FIG. 12 or a subsonic PCA article FIG. 15 without a neck according to one or more embodiments disclosed herein.

FIG. 17 illustrates subsonic PCA article 1710 which is the same as PCA article 1510 except the casing 1720 has no neck 1727 the projectile 610 being held by the Shoulder and cavity casing.

Figure 18C:
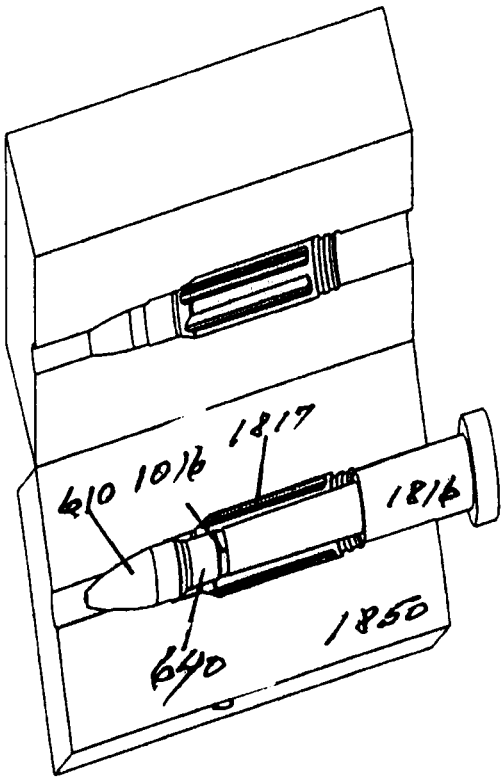
FIGS. 18A and 18B depict a projectile illustrated in FIG. 6 projectile and a core pull inserted in a mold for making a subsonic casing with external ribs according to one or more embodiments disclosed herein.
Figure 18B:
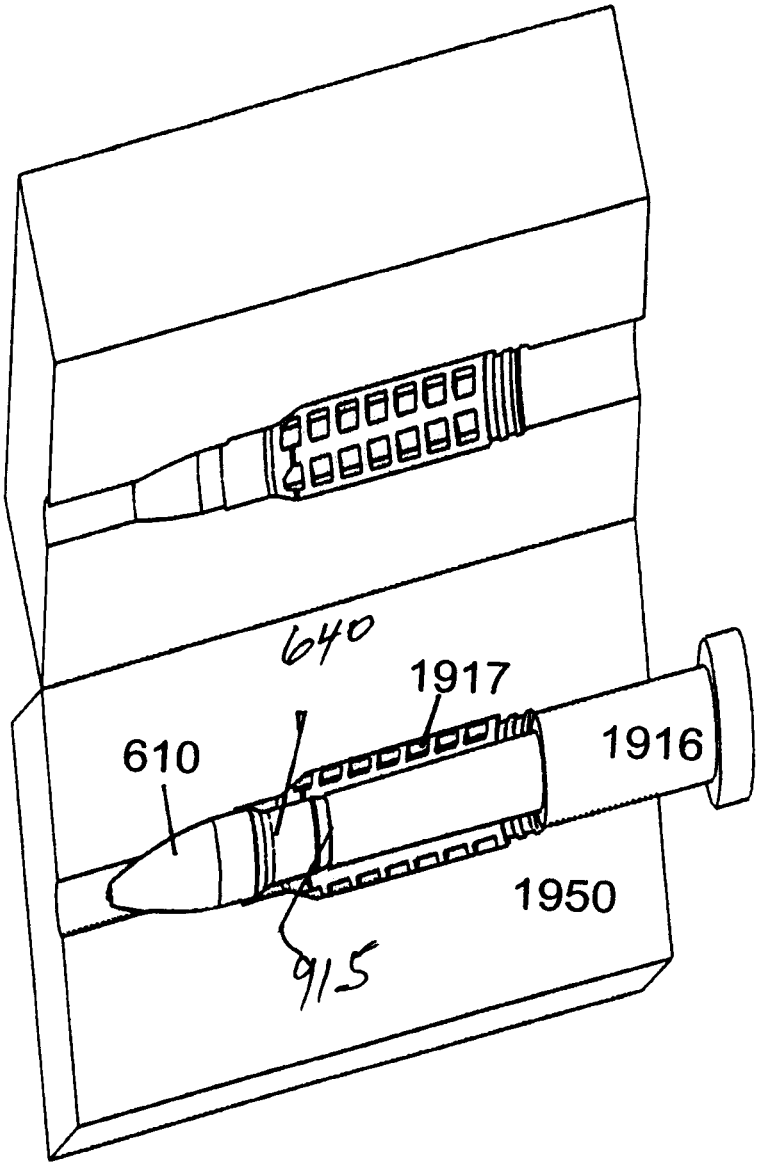

FIGS. 18 through 21 illustrate subsonic PCA article 2110 with external ribs from an associated mold 1850 according to one or more embodiments made according to the one or more methods 100. FIG. 18 illustrates an open mold 1850 with a projectile seat 1815 and a mold cavity 1817 that reveals the casing outer dimensions including external longitudinal ribs.

Figure 19A:
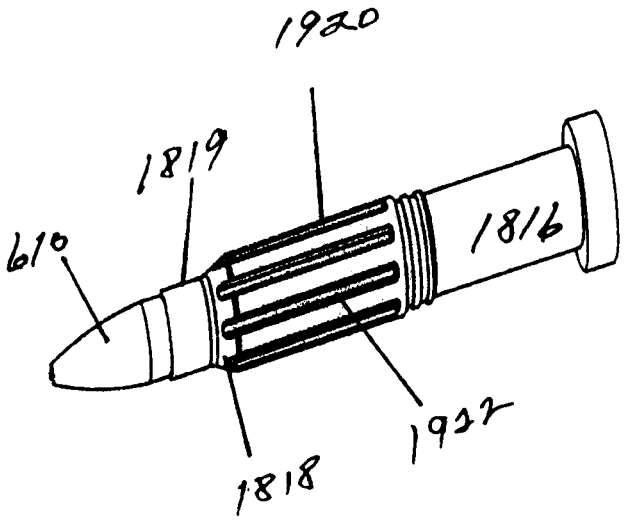
FIGS. 19A and 19B depict a casing made in the mold of FIG. 18 according to one or more embodiments disclosed herein.
Figure 19B:
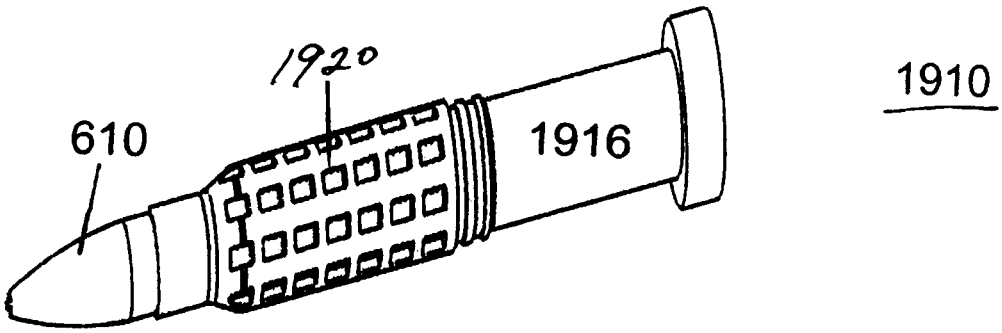
Figure 20:
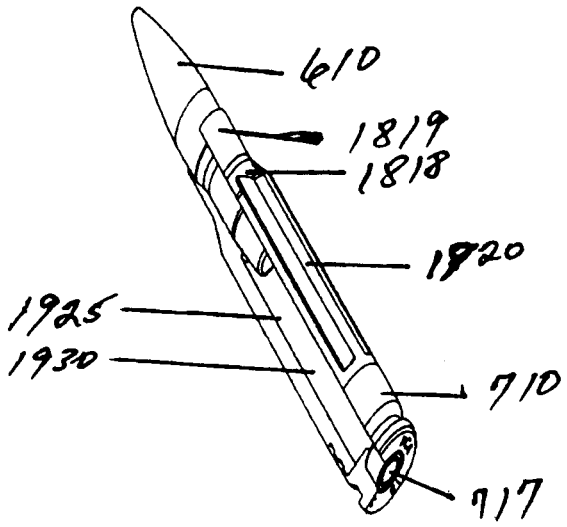
FIG. 20 depicts a subsonic PCA article made with the FIG. 19 casing with external ribs according to one or more embodiments disclosed herein.
Figure 21:
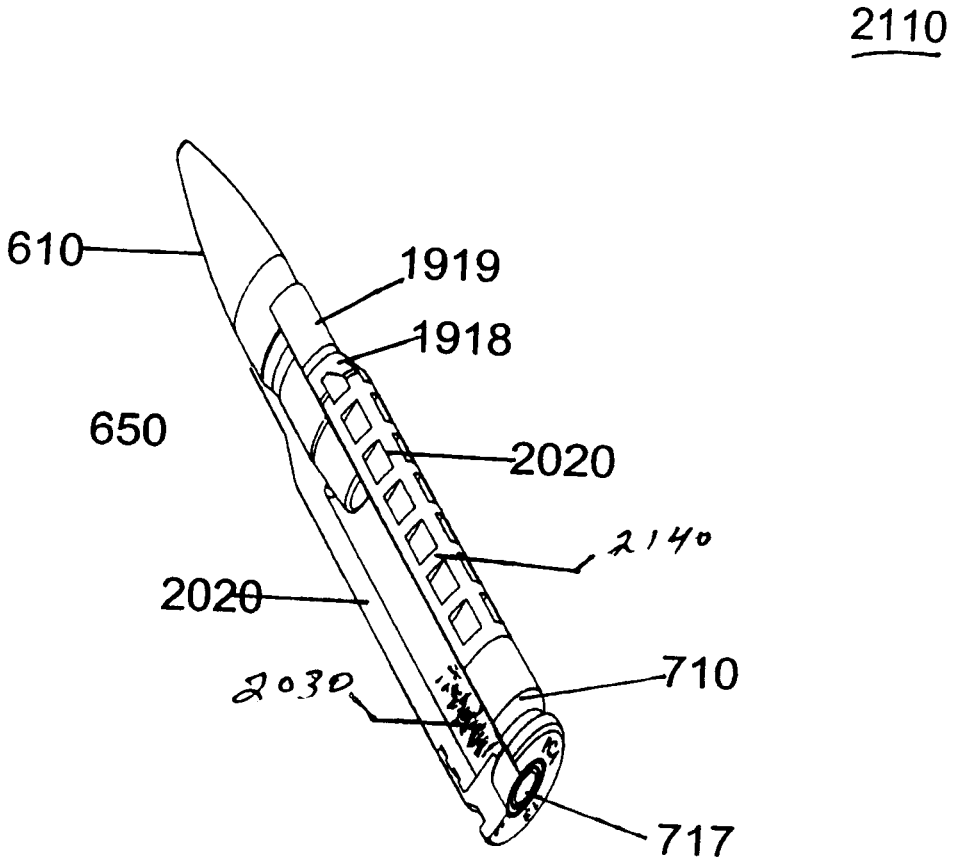
FIG. 21 depicts a subsonic PCA article made with FIGS. 18 and 19 with both external ribs and collars according to one or more embodiments disclosed herein.

Projectile 610 is positioned in the projectile seat 1815 and a core pull 1816 is inserted in the mold and seated against the textured projectile trailing end 640. Polymer is injected through one or more gates in the mold and flows in the mold cavity 1817 around the core pull forming the cavity 1925 and around the projectile tapered trailing end forming the shoulder 1818 and neck 1819. FIG. 19 illustrates a subsonic casing 1920 that was molded in FIG. 18 which reveals the cavity 1920. FIG. 20 illustrates a subsonic casing 1920 with a propellant charge 2030 loaded in the cavity 1925 and a primed base cap 710 attached to the second end, thereby, completing subsonic PCA article 2010 with external ribs 1922, thicker neck, and cavity walls and a smaller cavity and propellant charge. The ribs will lighten the casing while also strengthening the casing. FIG. 21 is a modified design of FIG. 20 which adds collars 2140 around the casing for strength. FIG. 21 illustrates article 2110 that would be molded in 1850 with a modified mold cavity profile showing ribs and collars and would be assembled the same as 2010 but 2110 would have collars added.

Figure 22:
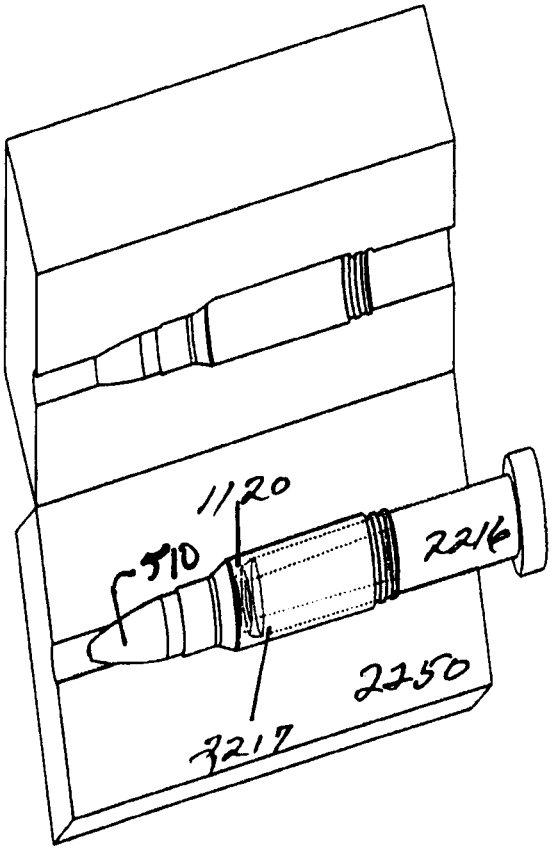
FIG. 22 depicts a mold with a core pull inserted in a mold for making a supersonic cavity sleeve ("cavity sleeve") according to one or more embodiments disclosed herein.
Figure 23:
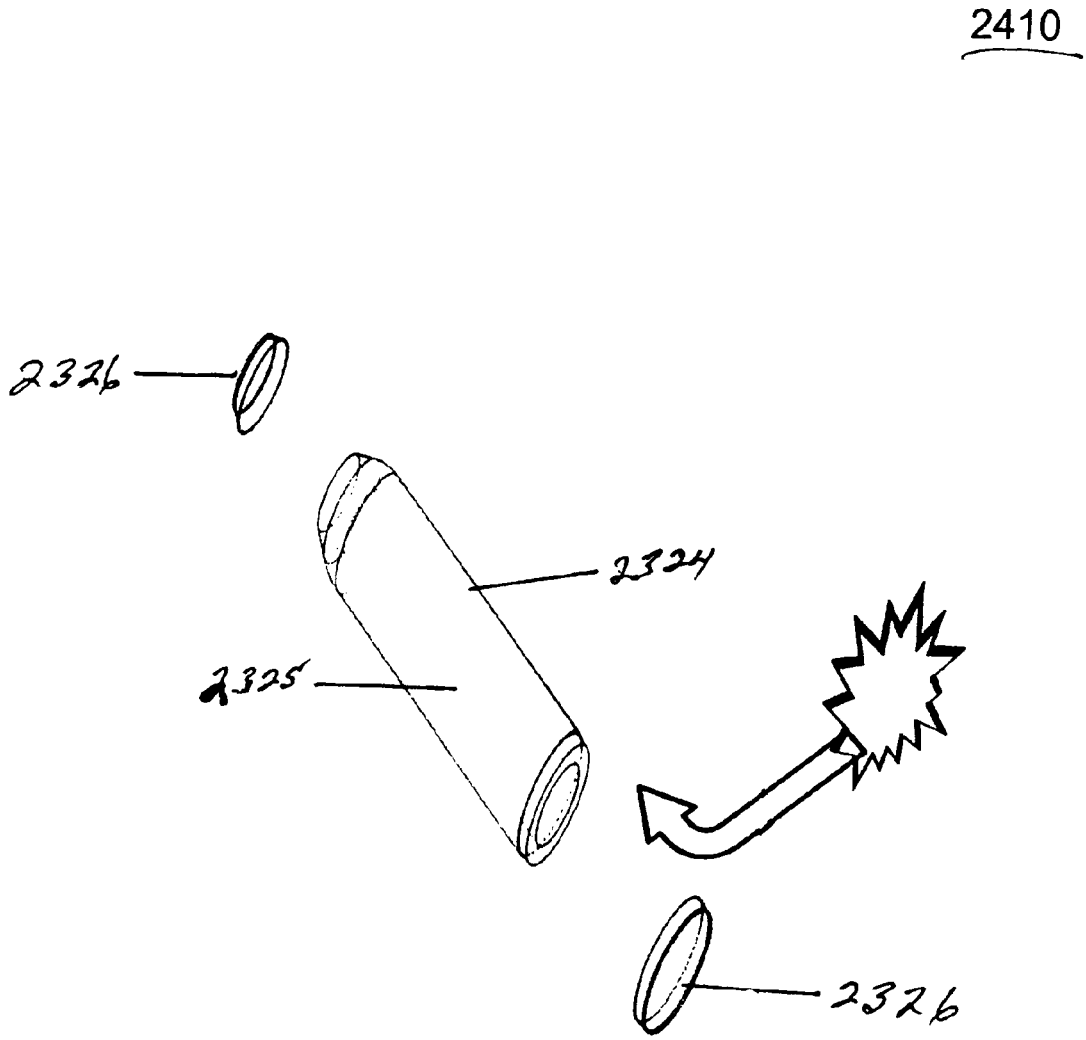
FIG. 23 depicts a cavity sleeve made in the one or more embodiments illustrated in FIG. 22 and according to one or more embodiments disclosed herein.
Figure 24:
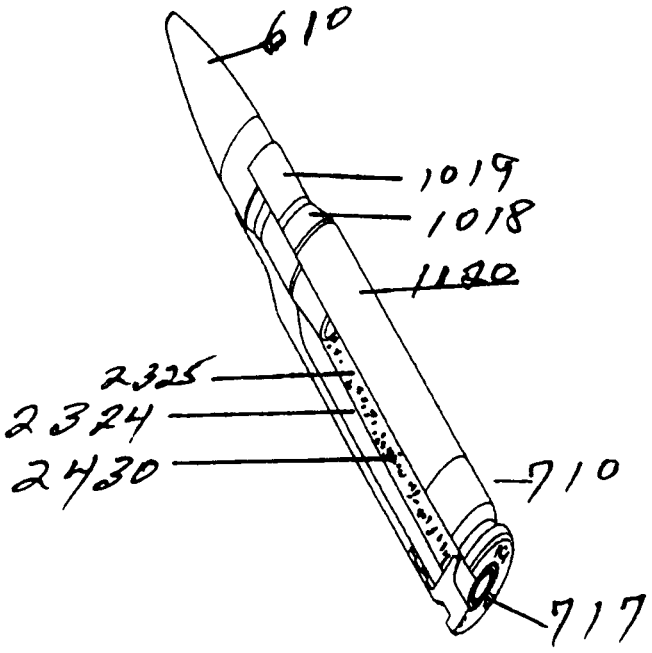
FIG. 24 depicts a subsonic PCA article converted to subsonic by use of the FIG. 23 cavity sleeve according to one or more embodiments disclosed herein.

FIGS. 22 through 24 illustrate a cavity sleeve 2324 from an associated mold 2250 according to one or more embodiments made according to the one or more methods 200. FIG. 22 illustrates an open mold 2250 tooled to mold cavity sleeves sized to fit in the cavity of supersonic casing 1120. Core pull 2216 is inserted in mold 2250 and polymer is injected through one or more gates in the mold and flows in the mold cavity 2217 around the core pull forming cavity sleeve 2324. FIG. 23 illustrates the cavity sleeve 2324 which reveals a subsonic cavity 2325. On either end of the cavity sleeve are two rings 2326 which have a membrane to contain the propellant charge if loaded before the sleeve is loaded in casing 1120. Furthermore, FIG. 23 illustrates a supersonic casing 1120 with a sleeve 2324 inserted therein; thereby, converting the supersonic casing 1120 into a subsonic casing 2328. FIG. 24 illustrates a converted casing 1120 with a subsonic propellant charge 2430 loaded in cavity 2325 and a primed base cap 710 attached to the casing second end, thereby, completing the conversion of a supersonic casing 1120 to a subsonic PCA article 2410 with a thicker cavity wall and a smaller cavity and propellant charge.

Figure 25:
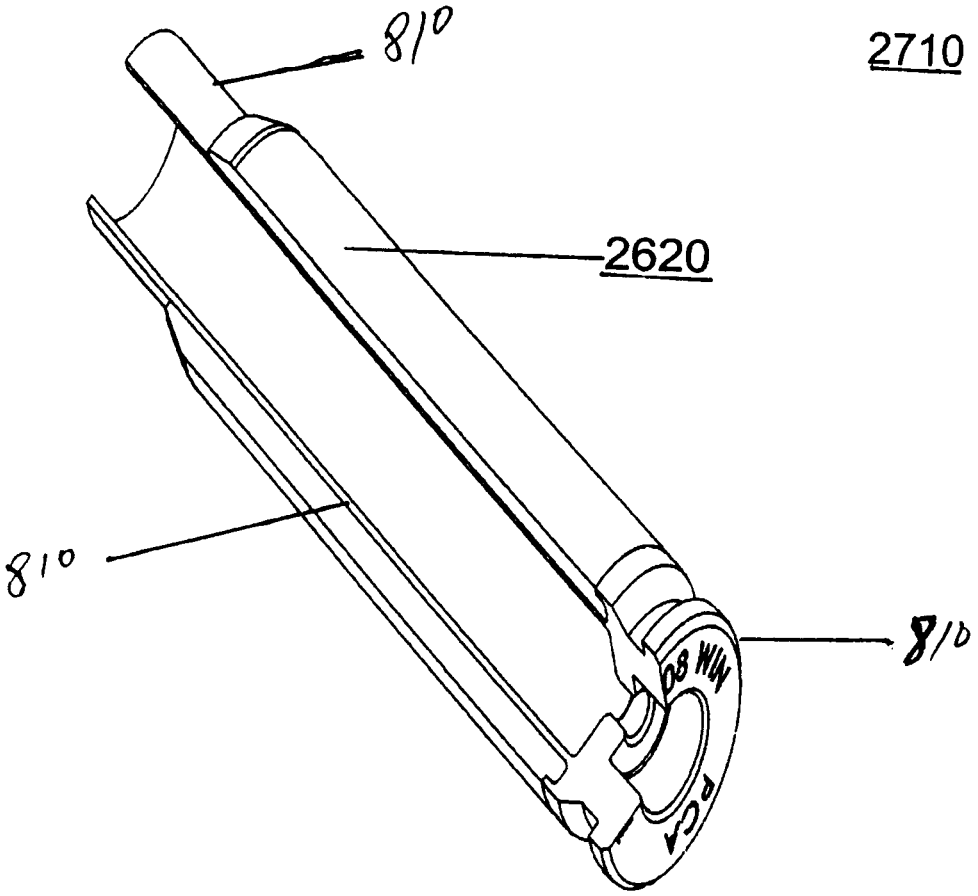
FIG. 25 depicts a subsonic PCA casing molded in FIG. 25 over the core sleeve according to one or more embodiments disclosed herein.
Figure 26:
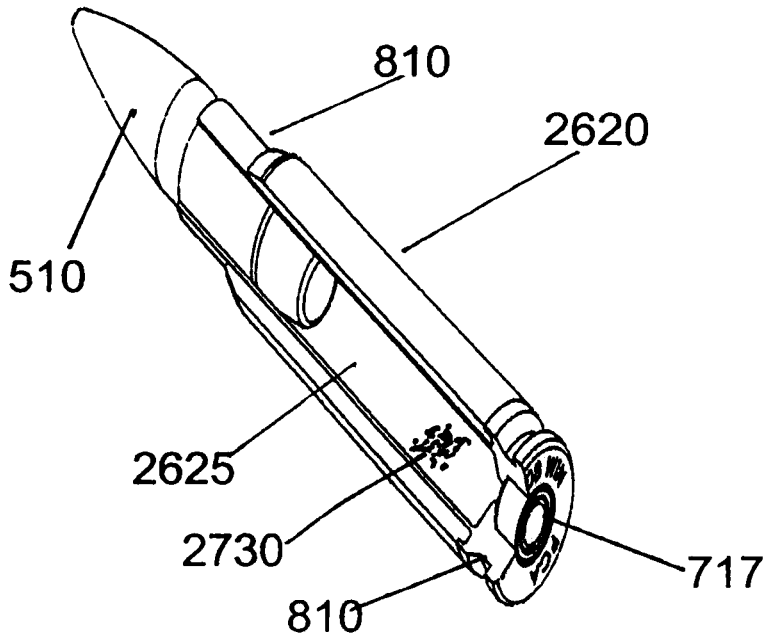
FIG. 26 depicts a subsonic PCA article made with FIG. 26 casing according to one or more embodiments disclosed herein.

FIGS. 25 through 26 illustrate subsonic PCA article 2710 from an associated mold 2550 according to one or more embodiments made according to the one or more methods 300. FIG. 25 illustrates casing 2620 when the core pull is removed with the core sleeve remaining within the casing 2620. FIG. 26 illustrates casing 2620 with a subsonic polymer charge 2730 loaded in the cavity 2620 through the neck and projectile 510 inserted in the neck using one of several methods to create neck tension, thereby, completing the conversion of supersonic PCA casing 1120 to subsonic article 2710 with a metal neck, a thicker cavity wall and a smaller cavity and propellant charge.

The one or more ammunition articles disclosed herein may have various advantages over conventional ammunition articles. As described, the ability to form a case cavity volume equal to the desired propellant charge propellant charge volume for a specified caliber and projectile is essential to achieve consistent desired ballistics. Additionally, the gap of unfilled area in the casing associated with, for example, conventional subsonic ammunition articles is reduced or eliminated. Furthermore, the casing strength may be increased due to the thickness of the sidewall and polymer cased ammunition articles will be lighter weight than metal articles of the same characteristics.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A method of making an ammunition article, comprising:

providing a projectile having at least one portion that defines a texturing, wherein the texturing extends from a rear facing portion of the projectile to a medial portion of the projectile;

determining a desired propellant charge for the projectile in order to achieve one or more characteristics, the one or more characteristics including a subsonic ammunition fire for the projectile;

selecting a core pull having at least one dimension corresponding to a dimension of a desired propellant charge volume corresponding to the subsonic ammunition fire for the projectile;

injection molding a polymer material in a mold around the core pull and a portion of the projectile to form a casing, the injection molding covering the texturing, wherein the portion of the projectile forward of the casing neck is free of texturing, the texturing being provided for projectile pull tension and for preventing a dielock condition when the texturing is injection molded around; and removing the core pull to define a propellant charge cavity within the casing, the propellant charge cavity having a volume corresponding to the desired propellant charge volume.

2. The method of claim 1, wherein a trailing end of the projectile about which material is molded around defines a taper, the taper extending at least about one-seventh of a length of the projectile and defining an increased casing thickness about the taper.

3. The method of claim 2, wherein injection molding a material comprises injection molding one of a thermal polymer, ceramic, metal, or a composite.

4. The method of claim 3, wherein the material in the step of injection molding a material includes one of a plasticizer, lubricant, molding agent, filler, thermo-oxidative stabilizers, flame-retardants, coloring agents, compatibilizers, impact modifiers, release agents, and reinforcing fibers.

5. The method of claim 2, wherein injection molding around the one of the boat tail or taper defines a seat against which the projectile abuts, and further wherein injection molding around the one of the boat tail or taper defines an area of increased thickness compared to a portion molded around a portion of the projectile that does not define one of a boat tail or taper.

6. The method of claim 2, further includes providing a base cap that is cold formed from metal or injection molded from polymer, ceramic, metal, or a composite material and into which a primer is inserted to ignite the propellant charge.

7. The method of claim 1, wherein the casing defines:

a first end at which the projectile is molded around, and a second end; and the method further includes attaching a primed base cap to the second end.

8. The method of claim 1, further including loading a propellant charge in the cavity.

9. The method of claim 8, wherein loading a propellant charge in the cavity comprises loading one of a gun powder or a composite of propellant materials that are substantially free of filler material and that occupy substantially all of the predetermined propellant charge volume.

10. The method of claim 1, further including:

preheating the projectile and molding into which the core pull is placed; and/or cycling heat in the mold including inductive heating.

11. The method of claim 1, wherein injection molding around the core pull defines an area of increased thickness in the casing wall.

12. The method of claim 1, wherein the ammunition article is free of a neck portion about the projectile.

13. The method of claim 1, wherein the mold defines one or more ribs and collars to thereby define corresponding ribs and collars on the casing after the step of injection molding in a mold.

14. The method of claim 1, further including inserting a sleeve into the propellant charge cavity to reduce the volume of the propellant charge cavity.

15. The method of claim 1, wherein the texturing extends from a distal end of the projectile to a medial portion of the projectile.

16. The method of claim 1, wherein the texturing extends from a distal end of the projectile to about one third to one half of the length of the projectile depending on its length and caliber.

17. The method of claim 1, wherein the projectile defines a cannelure in a taper of the projectile, the cannelure defined circumferentially thereabout the taper of the projectile.

18. A method of making a subsonic ammunition article comprising:

providing a projectile defining a texturing around a circumferentially extending portion thereof, wherein the texturing extends from a rear facing portion of the projectile to a medial portion of the projectile;

determining an internal diameter and shape of a casing to hold a propellant charge that will produce a subsonic discharge for the projectile in a casing of a predetermined length;

providing a core pull having an outer diameter and shape equal to the determined internal diameter and shape of the casing cavity;

injection molding a polymer based material around the core pull in a mold to form the casing having the determined inner diameter and shape, the injection molding covering the texturing, wherein the portion of the projectile forward of the casing neck is free of texturing, the texturing being provided for projectile pull tension and for preventing a dielock condition when the texturing is injection molded around; and removing the core pull to reveal the propellant cavity within the casing.

19. A subsonic ammunition article having an integrally formed casing wherein an interior facing surface of the casing forms a casing volume made by the process of:

providing a projectile defining a texturing around a circumferentially extending portion thereof, wherein the texturing extends from a rear facing portion of the projectile to a medial portion of the projectile;

determining an internal diameter and shape of a casing cavity to hold a propellant charge that will produce a subsonic discharge for the projectile in a casing of a predetermined length;

providing a core pull having a diameter and shape equal to the determined internal diameter and shape of the casing cavity;

injection molding a polymer based material around the core pull in a mold to form the casing having the determined inner diameter and shape wherein the entire casing is made from the same injection molding step, the injection molding covering the texturing, wherein the portion of the projectile forward of the casing neck is free of texturing, the texturing being provided for projectile pull tension and for preventing a dielock condition when the texturing is injection molded around; and removing the core pull to reveal a propellant charge cavity within the casing.

* * * * *